US007152435B2

(12) United States Patent
Sonomura et al.

(10) Patent No.: US 7,152,435 B2
(45) Date of Patent: Dec. 26, 2006

(54) WEFT KNITTING MACHINE HAVING MOVABLE SINKER

(75) Inventors: Minoru Sonomura, Wakayama (JP); Masaki Miyamoto, Wakayama (JP); Toshiaki Morita, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/566,251

(22) PCT Filed: Jul. 28, 2004

(86) PCT No.: PCT/JP2004/010729

§ 371 (c)(1),
(2), (4) Date: Jan. 30, 2006

(87) PCT Pub. No.: WO2005/012613

PCT Pub. Date: Feb. 10, 2005

(65) Prior Publication Data

US 2006/0243001 A1 Nov. 2, 2006

(30) Foreign Application Priority Data

Jul. 30, 2003 (JP) ..... 2003-283040
Jul. 30, 2003 (JP) ..... 2003-283041
Jul. 30, 2003 (JP) ..... 2003-283043

(51) Int. Cl.
*D04B 15/06* (2006.01)

(52) U.S. Cl. ..... 66/106

(58) Field of Classification Search ..... 66/104, 66/106, 107, 64, 90, 114, 115
See application file for complete search history.

(56) References Cited

U.S. PATENT DOCUMENTS 4,741,181 A 5/1988 Plath
5,134,865 A 8/1992 Shima et al.
5,231,845 A * 8/1993 Sumitani et al. ..... 62/160
5,333,473 A * 8/1994 Miyamoto ..... 66/106
5,475,991 A * 12/1995 Yabuta et al. ..... 66/106

(Continued)

FOREIGN PATENT DOCUMENTS

EP 0 672 769 A1 9/1995

(Continued)

OTHER PUBLICATIONS

International PCT Search Report, International Preliminary Examination Report and Written Opinion.

*Primary Examiner*—Danny Worrell
(74) *Attorney, Agent, or Firm*—Harness, Dickey & Pierce, P.L.C.

(57) ABSTRACT

A weft knitting machine having a movable sinker capable of securing a large space at a needle bed near a knitting fabric knitting area and making a pause in the state of stopping action on the knitting fabric knitting area. A sinker operating cam mechanism (10) installed in a carriage acts on the butt (12*c*) of a sinker jack (12) to move the sinker jack (12) backward from a mouth part (2) so that the acting part (8*c*) of the movable sinker (8) can retract from the mouth part (2). The sinker jack (12) is locked to a moved back position by a locking mechanism (16). Since a wire (17) passed through a needle plate (5) is utilized to lock the sinker jack (12) in the locking mechanism (16), the locking mechanism (16) can be reduced in size. To lock the sinker jack (12) to the wire (17), the sinker jack (12) comprises a projection (12*f*).

14 Claims, 18 Drawing Sheets

U.S. PATENT DOCUMENTS

| | | | | |
|---|---|---|---|---|
| 5,918,483 | A * | 7/1999 | Schmid et al. | 66/64 |
| 6,079,233 | A | 6/2000 | Shima | |
| 6,568,222 | B1 | 5/2003 | Morita | |
| 2005/0183466 | A1 | 8/2005 | Morita et al. | |

FOREIGN PATENT DOCUMENTS

| | | | |
|---|---|---|---|
| JP | 5-59642 | A | 3/1993 |
| JP | 5-83657 | B2 | 11/1993 |
| JP | 7-96740 | B2 | 10/1995 |
| JP | 7-258946 | A | 10/1995 |
| JP | 3333304 | B2 | 10/1995 |
| JP | 9-31806 | A | 2/1997 |
| JP | 10-25647 | A | 1/1998 |
| JP | 11-107143 | A | 4/1999 |
| JP | 2001-32151 | A | 2/2001 |
| JP | 3140990 | B2 | 3/2001 |
| WO | WO 01/36730 | A1 | 5/2001 |
| WO | WO 03/102285 | A1 | 12/2003 |

* cited by examiner

WEFT KNITTING MACHINE HAVING MOVABLE SINKER

TECHNICAL FIELD

The present invention relates to a weft knitting machine having movable sinkers that can press a knitted fabric at an appropriate timing during knitting.

BACKGROUND ART

As disclosed in Japanese Examined Patent Publication JP-B2 5-83657 (1993), for example, a sinker apparatus has been conventionally used that includes, between knitting needles arranged on a needle bed in a weft knitting machine, a movable sinker displaced by a cam mechanism provided on a carriage such that the movable sinker is swingingly displaced with, as a supporting point, the vicinity on the side of a needle bed gap of the needle bed, so that the front end of the movable sinker moves forward into the needle bed gap and is withdrawn from the needle bed gap. In this case, the carriage is provided with two separate press cams. The front end of the movable sinker is swingingly displaced by an action of one press cam and moves back and forth with respect to the side of the needle bed gap in conjunction with the travel of the carriage. Thus, the movable sinker can press a knitted fabric, and can be withdrawn from the needle bed gap to prevent, for example, a mechanical contact with other components from being caused in the narrow needle bed gap. A force of a spring is also applied to the movable sinker. When a resisting force from a knitting yarn becomes greater than the force of the spring, there is room in which the front end of the movable sinker moves backward from the needle bed gap, and thus too strong a tensile force can be prevented from being applied to the knitting yarn. When the carriage moves away, a state is kept in which the movable sinker has moved forward into the needle bed gap by the force of the spring.

Furthermore, when a knitted fabric is knitted with the carriage by letting knitting needles move forward into and backward from the needle bed gap, in a case where compound needles are used as the knitting needles, the amount of the back and forth displacement can be made smaller than in a case where latch needles are used, so that a knitting cam provided on the carriage can be made smaller. In a case where compound needles are used, as disclosed in Japanese Unexamined Patent Publication JP-A 7-258946 (1995), for example, a yarn guide member whose front end is moved forward into the needle bed gap in conjunction with a knitting needle to guide a knitting yarn to a hook is used together with a movable sinker in order to reliably feed a knitting yarn to the hook at the front end of the knitting needle. As in the sinker apparatus in JP-B25-83657, the movable sinker is swingingly displaced centering about a supporting point that is supported at the vicinity on the side of the needle bed gap of the needle bed, so that the front end of the movable sinker can move back and forth with respect to the side of the needle bed gap.

The movable sinkers as disclosed in JP-B2 5-83657 and JP-A 7-258946 are swingingly displaced while supported at the vicinity on the side of the needle bed gap of the needle bed. By a cam mechanism provided on the carriage pressing a portion close to the support portion to the side of the bottom face of the needle bed, the swinging displacement is performed in which the front end of the movable sinker moves back and forth with respect to the side of the needle bed gap. On the contrary, as disclosed in Japanese Unexamined Patent Publication JP-A 5-59642 (1993), for example, a configuration is also possible in which a portion close to the support portion of the sinker that is swingingly displaced is engaged with the front end of the sinker jack that is linearly displaced forward into and backward from the needle bed gap, and the sinker is switched between an upper needle bed and a lower needle bed of a weft knitting machine with a double-deck bed.

Furthermore, in a weft knitting machine having the structure in which front and rear needle beds are opposed to each other with the needle bed gap interposed therebetween, various types of knitting is made possible by enabling a pattern with a racking and a fashioned knitted fabric, for example, to be knitted with a racking operation in which the front and rear needle beds are shifted relative to each other. However, in a case where a knitted fabric is knitted using a thick knitting yarn, when a racking operation is performed, there is a possibility of damaging by the front end of the sinker scratching a knitted fabric that is hooked on a knitting needle on the needle bed opposed thereto, and thus it is preferable that the front end of the sinker is moved backward from the needle bed gap. A movable sinker apparatus that is swingingly displaced is provided with rest retaining means for letting the movable sinker be at rest in a state where the front end is moved backward from the needle bed gap, even after the carriage has passed, as disclosed in Japanese Unexamined Patent Publication JP-A 9-31806 (1997). The rest retaining means is achieved as a sinker rest retaining plate that moves forward into and backward from the needle bed gap linearly and in parallel with a knitting needle. When the sinker rest retaining plate is partially brought into contact with a movable sinker, the front end of the movable sinker is held in a state moved backward from the needle bed gap.

With the sinker apparatus in JP-B2 5-83657 and JP-A 9-31806, it is necessary that a cam mechanism for swingingly displacing the movable cam and for pressing the movable cam during a stitch determination is provided on the side of the carriage. Accordingly, the carriage has to cover the surface of the needle bed up to the range that is close to the needle bed gap, and thus a wide space cannot be secured at the needle bed close to the needle bed gap, which is an area for knitting a knitted fabric.

Furthermore, in order to increase the amount in which the front end of the movable sinker is displaced on the side of the needle bed gap, it is necessary to shorten the distance from the support portion of the movable sinker to the drive portion with respect to the distance from the support portion to the front end. In the configuration in which the movable sinker is swingingly displaced with a pressure from the carriage to the side of the bottom face of the needle bed as in JP-B2 5-83657 and JP-A 7-258946, it is necessary that a mechanism such as a press cam is provided on the side of the needle bed gap of the needle bed. Thus, the carriage is formed so as to cover the needle bed up to the vicinity of the needle bed gap, and thus becomes large.

In the most commonly used type of weft knitting machine, a pair of needle beds of the front and the rear face each other in the shape of a mountain with a needle bed gap interposed there between such that the needle beds become lower as being away from the needle bed gap. Thus, in the vicinity of the needle bed gap, which is an area for knitting a knitted fabric, the front and rear needle beds are close to each other and thus the space between the needle beds is narrow. In addition, it is necessary to provide a plurality of yarn feeders for feeding a knitting yarn and other components in this space. Accordingly, in order to make the weft knitting machine smaller and in order to make it possible to knit various types of knitted fabrics, it is necessary to secure a wide space in the vicinity of the needle bed gap.

Furthermore, in the movable sinker as in JP-B2 5-83657, a knitted fabric is pressed by a force of a spring, and when a resisting force of a knitting yarn becomes greater than the force of the spring, the movable sinker moves backward from the needle bed gap, and thus a tensile force applied to the knitting yarn can be relaxed, so that it is possible to prevent too strong a tensile force from being generated. However, it is necessary that the carriage is provided with a mechanism for pressing the vicinity of the support potion of the movable sinker, such that the movable sinker is swingingly displaced in the vicinity on the side of the needle bed gap of the needle bed, and thus the carriage has to cover the needle bed up to the vicinity on the side of the needle bed gap.

Furthermore, the sinker in JP-A 5-59642, a sinker that is swingingly displaced is shared between an upper needle bed and a lower needle bed of a double-deck bed, and the sinker is remotely driven via the sinker jack at the position away from the needle bed gap such that the sinker is operated for knitting a knitted fabric on either one of the needle beds. Thus, it is not necessary to provide, for example, a press mechanism for letting the sinker operate in the vicinity of the needle bed gap. The sinker is swingingly displaced in order to switch the operation object between the upper needle bed and the lower needle bed, and thus the sinker always acts on the knitted fabric that is knitted in either one of the needle beds. Furthermore, a force applied from the cam of the carriage to the sinker jack is transmitted, via the sinker that is swingingly displaced, to the knitting yarn, and there is no space in which the sinker can move backward from the needle bed gap even when a resisting force from the knitting yarn is received, and thus there is a possibility that too strong a tensile force is generated in the knitting yarn.

SUMMARY

It is an object of the invention to provide a weft knitting machine having movable sinkers, which can secure a wide space at a needle bed that is close to an area for knitting a knitted fabric, and which can be at rest in a state where an action on the area for knitting a knitted fabric is stopped.

It is another object of the invention to provide a small size weft knitting machine having movable sinkers, which can secure a wide space at a needle bed that is close to an area for knitting a knitted fabric.

It is another object of the invention to provide a weft knitting machine having movable sinkers, which can secure a wide space at a needle bed that is close to an area for knitting a knitted fabric, and which can move backward from the area for knitting a knitted fabric when a resisting force from a knitting yarn becomes strong in the area for knitting a knitted fabric, so that a tensile force generated in the knitting yarn can be relaxed.

The invention is directed to a weft knitting machine having movable sinkers, in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are, selectively moved forward into and backward from the area for knitting a knitted fabric, so that a knitted fabric is knitted by an interaction with the movable sinkers, wherein the end portions, on a side of the area for knitting a knitted fabric, of the needle plates have recess portions for supporting the movable sinkers such that the movable sinkers can be swingingly displaced, and wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, the weft knitting machine, comprising:

a sinker jack that is accommodated in each of the needle grooves, can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof;

a passing-through member that passes through each of the needle plates in a direction along the area for knitting a knitted fabric, and is inserted into the cutout portion of the sinker jack and thus regulates the sinker jack so as to be slidingly displaced without moving away from the needle groove;

a drive mechanism that is provided on the carriage, and is capable of selectively driving the sinker jack, by acting on the butt of the sinker jack, to move backward from the area for knitting a knitted fabric such that the operation portion of the movable sinker is withdrawn from the area for knitting a knitted fabric; and an interlock mechanism that is provided in a position away from the area for knitting a knitted fabric, within a range in which the sinker jack is displaced back and forth, in each of the needle grooves, and that interlocks, at a backward position so as to restrain the back and forth displacement in the needle grooves, the sinker jack driven by the drive mechanism so as to move backward.

Furthermore, the invention is characterized in that the interlock mechanism interlocks a protrusion provided on a side of the base portion of the sinker jack with a member passing through the needle plate in a direction along the area for knitting a knitted fabric.

Furthermore, the invention is characterized in that the drive mechanism uses a solenoid as a driving source, includes a cam that can switch between operation/non-operation in accordance with presence/absence of excitation of the solenoid, and moves, by operation of the cam, the butt backward to a position for interlocking with the interlock mechanism.

The invention is directed to a weft knitting machine having movable sinkers, in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are selectively moved forward into and backward from the area for knitting a knitted fabric, so that a knitted fabric is knitted by an interaction with the movable sinkers, wherein the end portions, on a side of the area for knitting a knitted fabric, of the needle plates have recess portions for supporting the movable sinkers such that the movable sinkers can be swingingly displaced, wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, wherein the knitting needle is disposed with the movable sinker side by side in a width direction in each of the needle grooves, and is a compound needle in which a needle main portion and a slider can be independently displaced forward into and backward from the area for knitting a knitted fabric, and wherein each of the needle grooves includes:

a sinker jack that can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof, a spacer that is disposed in a direction away from the base stage of the needle bed with respect to the knitting needle, whose bottom portion regulates the knitting needle so as not to move away from the base stage, whose side portion regulates the sinker jack so as not to be shifted in a width direction of the needle groove, and whose side portion has a groove that extends in a direction of the back and forth movement, and a yarn guide that has a base portion that is fitted into the groove of the spacer such that the base portion can slide in the direction of the back and forth movement, and a yarn pressing portion that is formed on a side of the area for knitting a knitted fabric with respect to the base portion and that can press a knitting yarn by moving forward into the area for knitting a knitted fabric, the weft knitting machine, further comprising:

a passing-through member that passes through the spacer and the needle plate in each of the needle grooves in a direction along the area for knitting a knitted fabric and thus fixes the spacer and the needle plate on each other, and that is inserted into the cutout portion of the sinker jack and thus regulates the sinker jack so as to be slidingly displaced without moving away from the needle groove.

Furthermore, the invention is characterized in that:

the base portion of the yarn guide that is fitted into the groove of the spacer and is slidingly displaced is provided with a protrusion, and the groove of the spacer is provided with a recess for regulating a range in which the protrusion of the yarn guide is displaced.

Furthermore, the invention is characterized in that the spacer is provided with an air path that is open on a side of a surface of the needle bed and that is in communication with a side of the area for knitting a knitted fabric of the knitting needle.

The invention is directed to a weft knitting machine having movable sinkers, in which in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, and a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are selectively moved forward into and backward from the area for knitting a knitted fabric, so that a knitted fabric is knitted by an interaction with the movable sinkers, wherein the end portions, on a side of the area for knitting a knitted fabric, of the needles plates have recess portions for supporting the movable sinkers such that the movable sinkers can be swingingly displaced, and wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, the weft knitting machine, comprising:

a sinker jack that is accommodated in each of the needle grooves, can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof, a passing-through member that passes through each of the needle plates in a direction along the area for knitting a knitted fabric, and is inserted into the cutout portion of the sinker jack and thus regulates the sinker jack so as to be slidingly displaced without moving away from the needle groove, and a spring for applying a force to the movable sinker such that the operation portion moves forward into the area for knitting a knitted fabric, wherein the passive portion of the movable sinker and the end portion of the sinker jack are engaged with each other by a force applied by the spring such that the passive portion and the end portion abut against each other on one side and a gap is provided for clearance on the other side.

Furthermore, the invention is characterized in that:

the operation portion of the movable sinker is provided with a catch for pressing a knitting loop that has been knitted, and the gap at a portion in which the passive portion of the movable sinker and the end portion of the sinker jack are engaged with each other is formed, within a range from a state in which the passive portion and the end portion abut against each other on one side of the gap to a state in which the passive portion and the end portion abut against each other on the other side of the gap, such that a position of the catch of the movable sinker is regulated to be on a side that is different from a position of a yarn feeding port for feeding a knitting yarn to a hook, with respect to a position through which the hook of the knitting needle passes when the knitting needle is displaced forward into and backward from the area for knitting a knitted fabric.

Furthermore, the invention is characterized in that:

the passive portion of the movable sinker has a protrusion that projects toward a side of the end portion of the sinker jack, the end portion of the sinker jack has a recess that is wider than a width of the protrusion, and the engagement is made with the recess and the protrusion.

Furthermore, the invention is characterized in that:

the end portion of the sinker jack has a protrusion that projects toward a side of the passive portion of the movable sinker, the passive portion of the movable sinker has a recess that is wider than a width of the protrusion, and the engagement is made with the recess and the protrusion.

BRIEF DESCRIPTION OF DRAWINGS

Other and further objects, features, and advantages of the invention will be more explicit from the following detailed description of example embodiments taken with reference to the drawings wherein.

DETAILED DESCRIPTION OF THE EXAMPLE EMBODIMENTS

Figure 1:
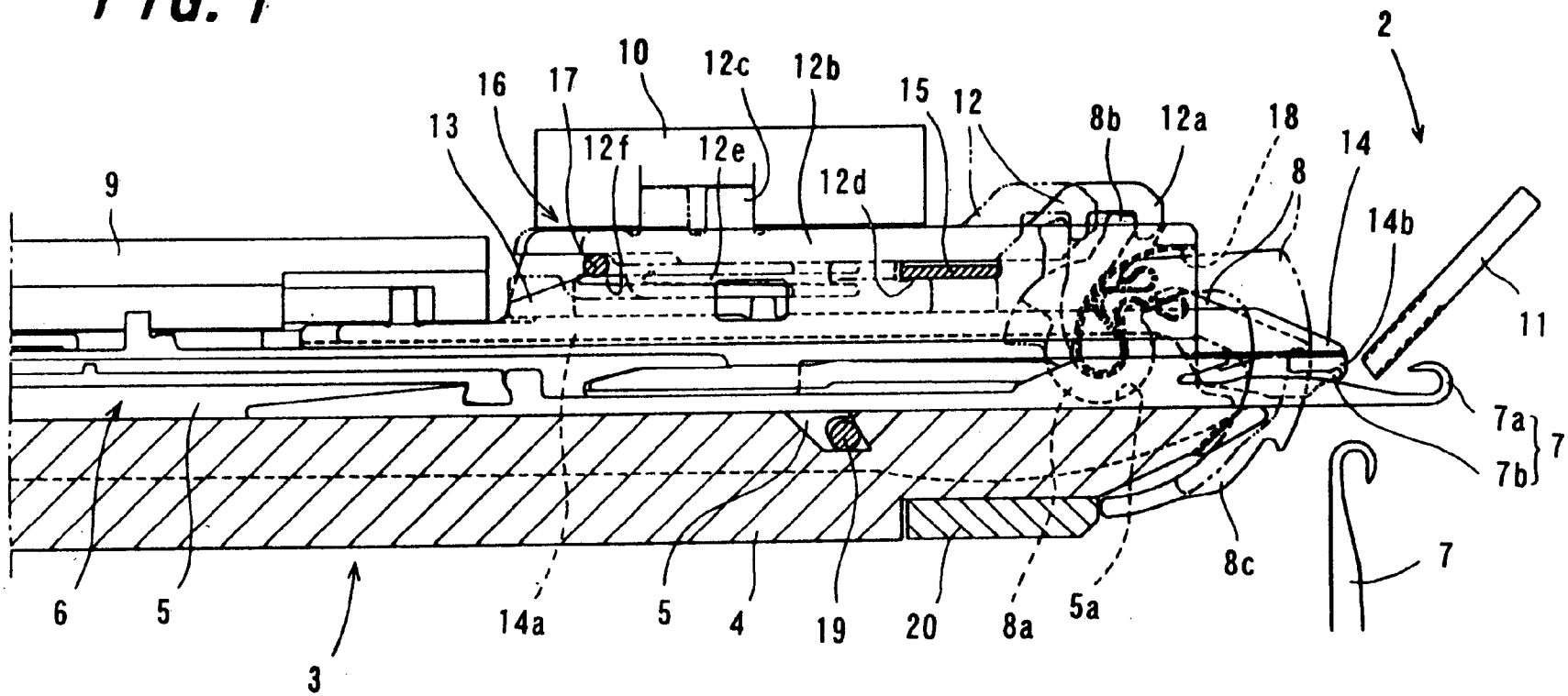
FIG. 1 is a lateral view showing the configuration of a main portion of a weft knitting machine 1, which is an embodiment of the invention.

Now referring to the drawings, example embodiments of the invention are described below.

FIG. 1 shows the configuration of a main portion of a weft knitting machine 1, which is an embodiment of the invention. In the weft knitting machine 1, front and rear needle beds are opposed to each other at a needle bed gap 2. In the drawings, one needle bed 3 is shown and the other needle bed is not shown. The needle bed 3 is inclined with respect to the needle bed gap 2 such that the needle bed 3 is high on the side of the needle bed gap and becomes lower as being away from the needle bed gap. In other words, the front and rear needle beds are arranged in the shape of V upside down that is centered on the needle bed gap. However, for the sake of convenience, the one needle bed 3 is shown in a horizontal state. The configuration with respect to the one needle bed 3 is basically similar to the configuration with respect to the other needle bed.

On a base stage 4 disposed facing the needle bed gap 2, which is an area for knitting a knitted fabric, a large number of needle plates 5 are arranged in the direction toward the needle bed gap 2. The needle plates 5 are formed so as to have a small plate thickness at the end portions on the side of the needle bed gap 2. Needle grooves 6 whose width becomes large on the side of the needle bed gap 2 are formed between the needle plates 5. A knitting needle 7 is accommodated in each of the needle grooves 6. A movable sinker 8 is accommodated at each of the end portions of the needle grooves 6 in which the width becomes large. The needle bed 3 is thus configured. In the weft knitting machine 1, the knitting needles 7 are selectively moved forward into and backward from the needle bed gap 2 while letting a carriage travel back and forth on the needle bed 3 along the needle bed gap 2, that is, in the direction that is perpendicular to the sheet of the drawing, so that a knitted fabric is knitted by an interaction with the movable sinkers 8. The carriage is not shown in the drawing, and a knitting needle operation cam mechanism 9 for letting the knitting needles 7 operate and a sinker operation cam mechanism 10 for letting the movable sinkers 8 operate are shown.

In the needle bed gap 2, it is possible to form knitting loops by feeding a knitting yarn from a yarn feeder 11 to the knitting needle 7. The knitting needle 7 is disposed with the movable sinker 8 side by side in the width direction in each of the needle grooves 6. Furthermore, the knitting needle 7 is a compound needle in which a needle main portion 7*a* and a slider 7*b* can be independently displaced forward into and backward from the needle bed gap 2. The end portion, on the side of the needle bed gap 2, of the needle plate 5 has a recess portion 5*a* that supports the movable sinker 8 such that the movable sinker 8 can be swingingly displaced. The movable sinker 8 has a support portion 8*a* that is supported by the recess portion 5*a*, a passive portion 8*b* that is driven following the back and forth displacement with respect to the needle bed gap 2, and an operation portion 8*c* that operates as a sinker with respect to the needle bed gap 2 when the back and forth displacement with respect to the passive portion 8*b* is converted into the swinging displacement with the support portion 8*a* serving as a supporting point.

A sinker jack 12 that can be linearly displaced forward into and backward from the needle bed gap 2 is accommodated in each of the needle grooves 6. At an end portion 12*a*, the sinker jack 12 is engaged with the passive portion 8*b* of the movable sinker 8. Furthermore, on the side of a base portion 12*b* that extends in the direction away from the needle bed gap 2 with respect to the end portion 12*a*, the sinker jack 12 has a butt 12*c* that projects in the direction away from the base stage of the needle bed. Furthermore, in the middle between the end portion 12*a* and the base portion 12*b*, the sinker jack 12 has a cutout portion 12*d* that extends in the direction of the back and forth displacement.

In each of the needle grooves 6, a spacer 13 is disposed in the direction away from the base stage 4 of the needle bed 3 with respect to the knitting needle 7. The bottom portion of the spacer 13 regulates the knitting needle 7 so as not to move away from the base stage 4, and the side portion of the spacer 13 regulates the sinker jack 12 so as not to be shifted in the width direction of the needle groove 6. A yarn guide 14 has a base portion 14*a* and a yarn pressing portion 14*b*. The base portion 14*a* is fitted into a groove formed on the side portion of the spacer 13, which extends in the direction of the back and forth movement, such that the base portion 14*a* can slide in the direction of the back and forth movement. The yarn pressing portion 14*b* is formed on the side of the needle bed gap 2 with respect to the base portion 14*a*, and can press a knitting yarn by moving forward into the needle bed gap 2.

An iron band 15 passes through the spacer 13 and the needle plate 5 in each of the needle grooves 6, in the direction along the needle bed gap, that is, in the direction that is perpendicular to the sheet of the drawing, and thus fixes the spacer 13 and the needle plate 5 on each other. The iron band 15 is inserted also into the cutout portion 12*d* of the sinker jack 12, and functions as a passing-through member for regulating the sinker jack 12 so as to be slidingly displaced without moving away from the needle groove 6.

The sinker operation cam mechanism 10 provided on the carriage includes a drive mechanism capable of selectively driving the sinker jack 12, by acting on the butt 12*c* of the sinker jack 12, to move backward from the needle bed gap 2 such that the operation portion 8*c* of the movable sinker 8 is withdrawn from the needle bed gap 2. The drive mechanism is described later. With an interlock mechanism 16, the sinker jack 12 that is driven by the drive mechanism so as to move backward is interlocked at the backward position. In the interlock mechanism 16, the sinker jack 12 is interlocked with a wire 17, which is a member passing through the needle plate 5 in the direction along the needle bed gap 2. Since the wire 17 passing through the needle plate 5 is used in order to interlock the sinker jack 12, the interlock mechanism 16 can be made compact. In order to interlock the sinker jack 12 with the wire 17, the sinker jack 12 has an extending portion 12*e* extending in the direction away from the needle bed gap 2 in its middle portion. The front end of the extending portion 12*e* is provided with a protrusion 12*f*. As described later, the protrusion 12*f* can be interlocked with the wire 17. It should be noted that a similar wire 19 is also used to fix the needle plate 5 on the base stage 4. Furthermore, a position, close to the needle bed gap 2, on the bottom portion of the base stage 4 is provided with a stopper 20 against which the front end of the operation portion 8*c* of the movable sinker 8 abuts so that the swinging displacement of the movable sinker 8 by a force of a wire spring 18 is regulated.

The swinging displacement of the movable sinker 8 with, as a supporting point, the support portion 8*a* that is supported by the recess portion 5*a* of the needle plate 5 can be remotely performed by driving the butt 12*c* of the sinker jack 12 in the direction of the back and forth displacement with the sinker operation cam mechanism 10 of the carriage. With this remote drive, the movable sinker 8 can be operated between a state indicated by the solid line in which the movable sinker 8 has moved forward into the needle bed gap and a state indicated by the dashed double dotted line in which the movable sinker 8 has moved backward from the needle bed gap 2. Even when the passive portion 8*b*, which receives a driving force for letting the movable sinker 8 operate from the end portion 12*a* of the sinker jack 12, is brought close to the support portion 8*a* in the vicinity of the needle bed gap 2, it is sufficient that the back and forth displacement of the sinker jack 12 is converted into the swinging displacement. Thus, it is not necessary that a mechanism for directly pressing the passive portion 8*b* is provided on the side of the carriage. Accordingly, the carriage can be made smaller by letting the carriage not cover the needle bed 3 up to the vicinity of the needle bed gap 2, and thus a wide space can be secured at the needle bed 3 close to the needle bed gap 2.

Since the interlock mechanism 16 lets the sinker jack 12 that is driven by the drive mechanism so as to move backward be interlocked at the backward position, it is possible to keep a state in which the sinker jack 12 is held at the backward position and thus the operation portion 8*c* of the movable sinker 8 has moved backward from the needle bed gap 2 even after the carriage has passed. When the needle bed gap 2 in which the front and rear needle beds are opposed to each other is used as an area for knitting a knitted fabric, it is possible to eliminate a possibility of damaging by scratching a knitted fabric, by letting the operation portion 8*c* of the movable sinker 8 be withdrawn from the needle bed gap 2 when various types of knitted fabrics are knitted in a racking operation.

A force of the wire spring 18 is applied to the movable sinker 8 such that the operation portion 8*c* moves forward into the needle bed gap 2. The passive portion 8*b* of the movable sinker 8 and the end portion 12*a* of the sinker jack 12 are engaged with each other by a force applied by the wire spring 18 such that the passive portion 8*b* and the end portion 12*a* abut against each other on one side and a gap is provided for a clearance on the other side. By providing this gap, when a resisting force from a knitting yarn, which is received by the operation portion 8*c* of the movable sinker 8, becomes greater than a force applied by the wire spring 18, there is room in which the movable sinker 8 is swingingly displaced such that the operation portion 8*c* moves backward from the needle bed gap 2, and thus a tensile force generated in the knitting yarn can be relaxed so as not to be too strong.

Since a compound needle that is constituted by the needle main portion 7*a* and the slider 7*b* is used as the knitting needle 7, a stroke in the back and forth displacement that is necessary for knitting a knitted fabric can be made smaller than that of a latch needle, so that the knitting needle operation cam mechanism 9 provided on the carriage can be made smaller. Since the movable sinker 8 and the yarn guide 14 are provided in each of the needle grooves 6, it is possible to reliably knit a knitted fabric with the compound needle.

Figure 2:
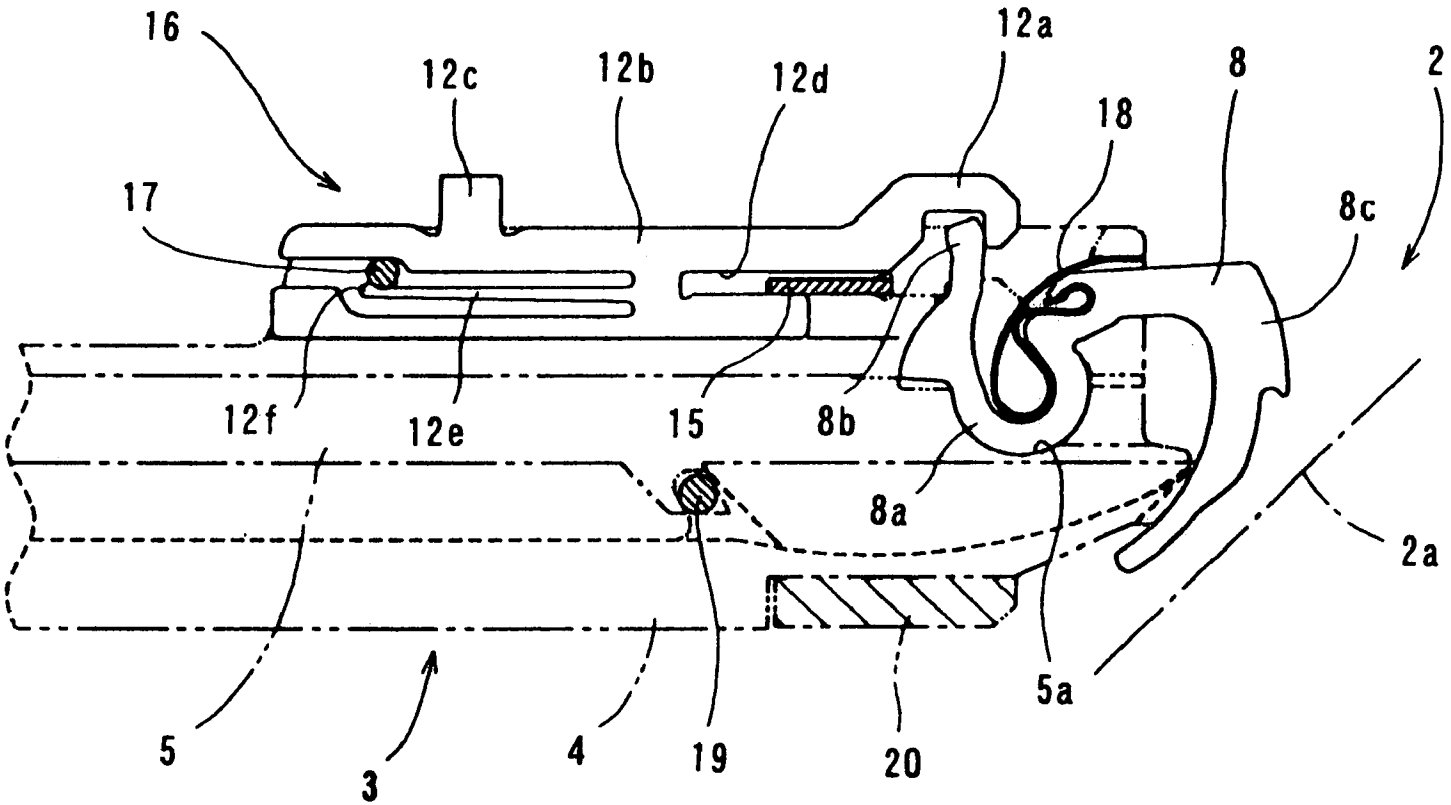
FIG. 2 is a lateral view of the vicinity of a needle bed gap 2 of the weft knitting machine in FIG. 1.

FIG. 2 shows a state in which the sinker jack 12 is moved to the rearmost from the side of the needle bed gap 2 and the protrusion 12*f* is interlocked with the wire 17 in the interlock mechanism 16. The extending portion 12*e* whose front end is provided with the protrusion 12*f* functions as a cantilever for the base portion 12*b*, and can be elastically deformed when the wire 17 surmounts the protrusion 12*f*. As long as this force causing the elastic deformation is not applied from the outside, the interlock mechanism 16 can keep the rest state of the movable sinker 8. The centerline of the needle bed gap 2 is denoted by 2*a*.

Figure 3:
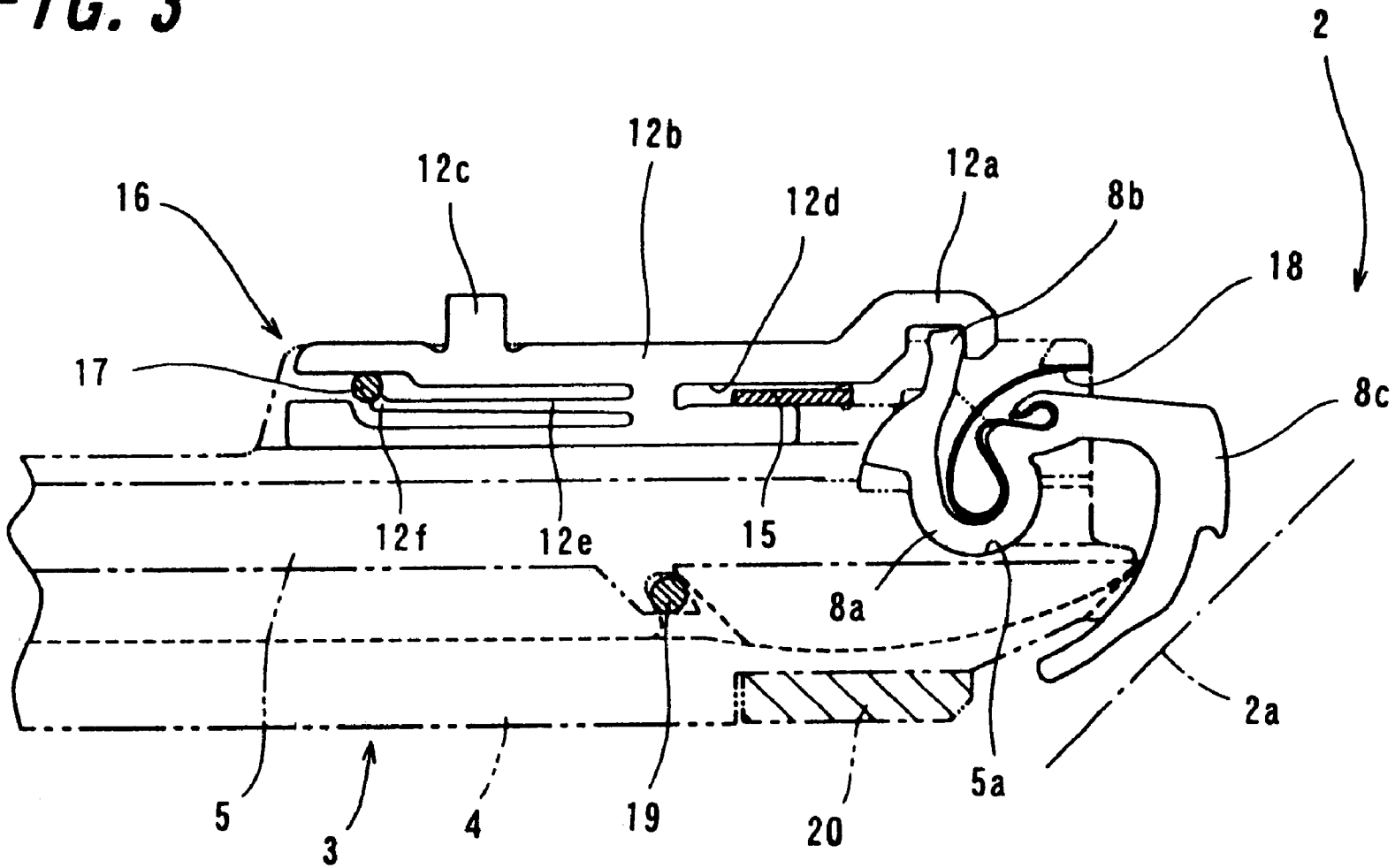
FIG. 3 is a lateral view of the vicinity of the needle bed gap 2 of the weft knitting machine in FIG. 1.
Figure 4:
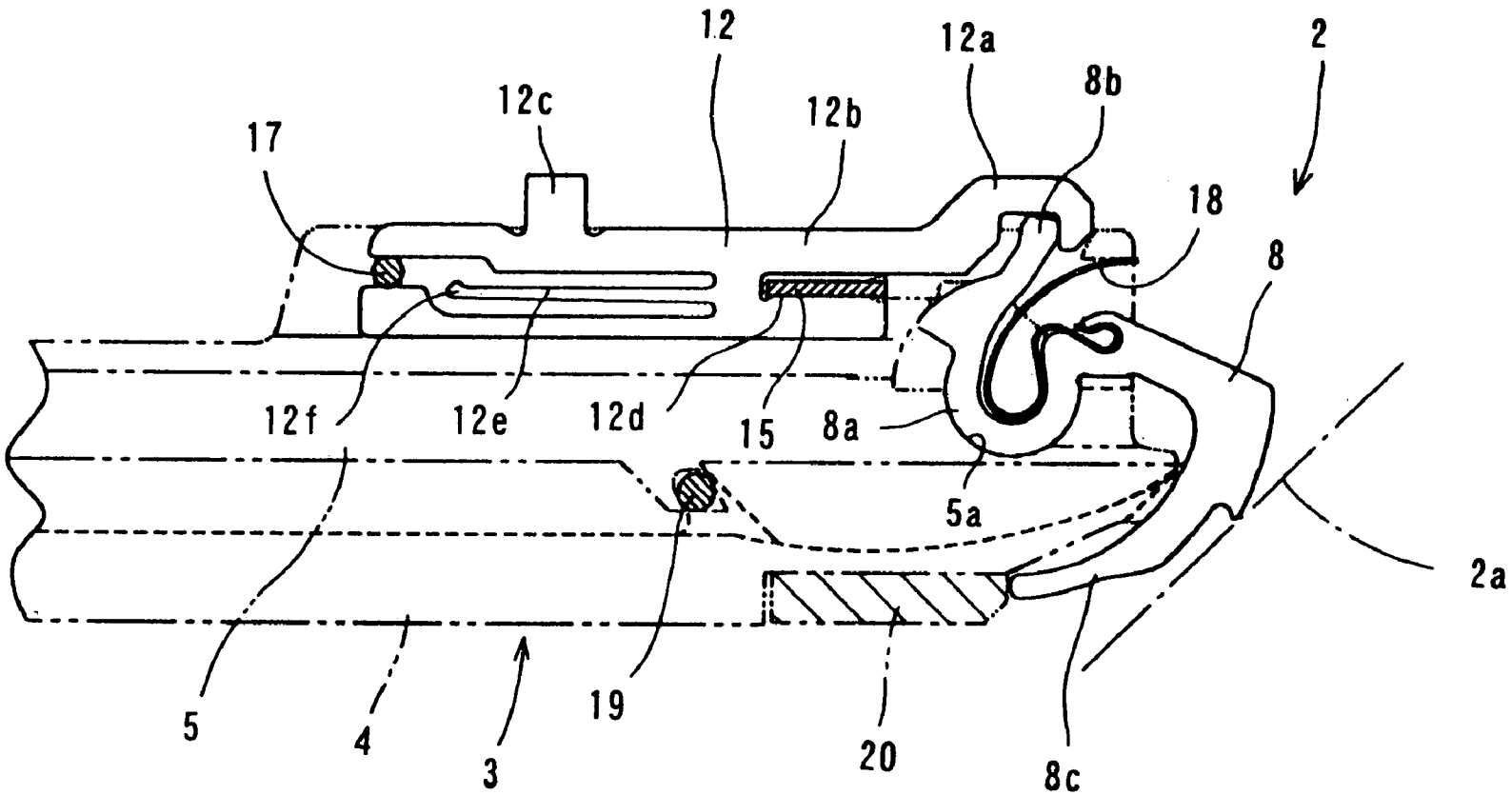
FIG. 4 is a lateral view of the vicinity of the needle bed gap 2 of the weft knitting machine in FIG. 1.
Figure 5:
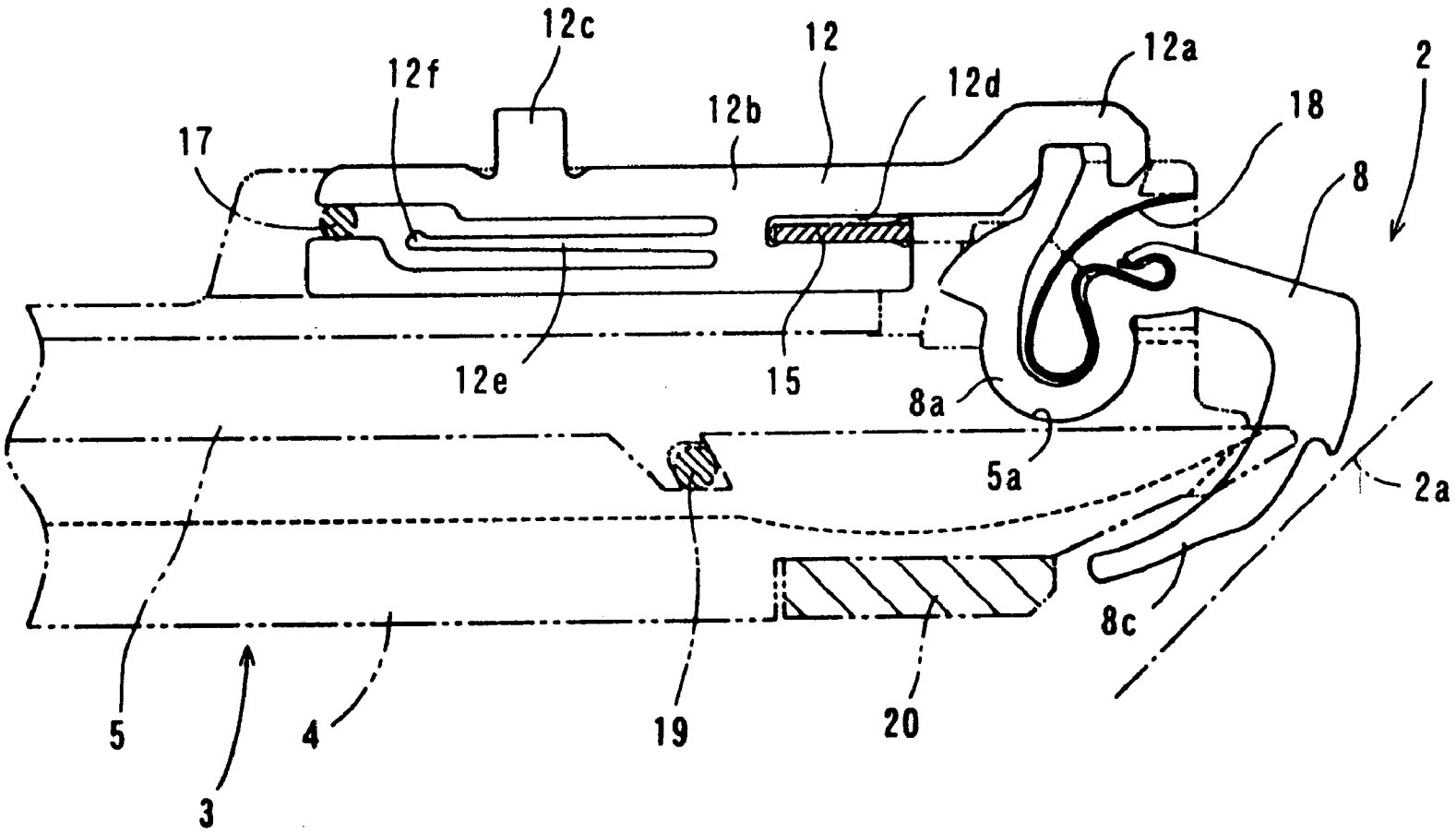
FIG. 5 is a lateral view of the vicinity of the needle bed gap 2 of the weft knitting machine in FIG. 1.

FIGS. 3 and 4 show states in which the movable sinker 8 is in the backward position and in the forward position. FIG. 5 shows a state in which when the movable sinker 8 is in the forward position, the movable sinker 8 is moved backward by a resisting force from a knitting yarn only for the amount of the gap provided at the end portion 12*a* of the sinker jack 12. This back ward displacement can be performed also in the backward position as in FIG. 3. In accordance with a knitting operation with the knitting needle 7, the movable sinker 8 can be moved between the backward position in FIG. 3 and the forward position in FIG. 4 to reliably press the knitted fabric. At that time, when the movable sinker 8 receives a resisting force that is greater than a force of the wire spring 18 from the knitting yarn, the movable sinker 8 can move backward to relax a tensile force of the knitting yarn. FIGS. 3 and 4 show that the iron band 15 is fitted into the cutout portion 12*d* of the sinker jack 12 and functions as a guide member for regulating the sinker jack 12 so as to be slidingly displaced without moving away from the needle plate 5. Furthermore, FIGS. 4 and 5 show that in the forward position, the end portion of the cutout portion 12*d* abuts against the side end of the iron band 15 and the iron band 15 functions also as a stopper.

Figure 6:
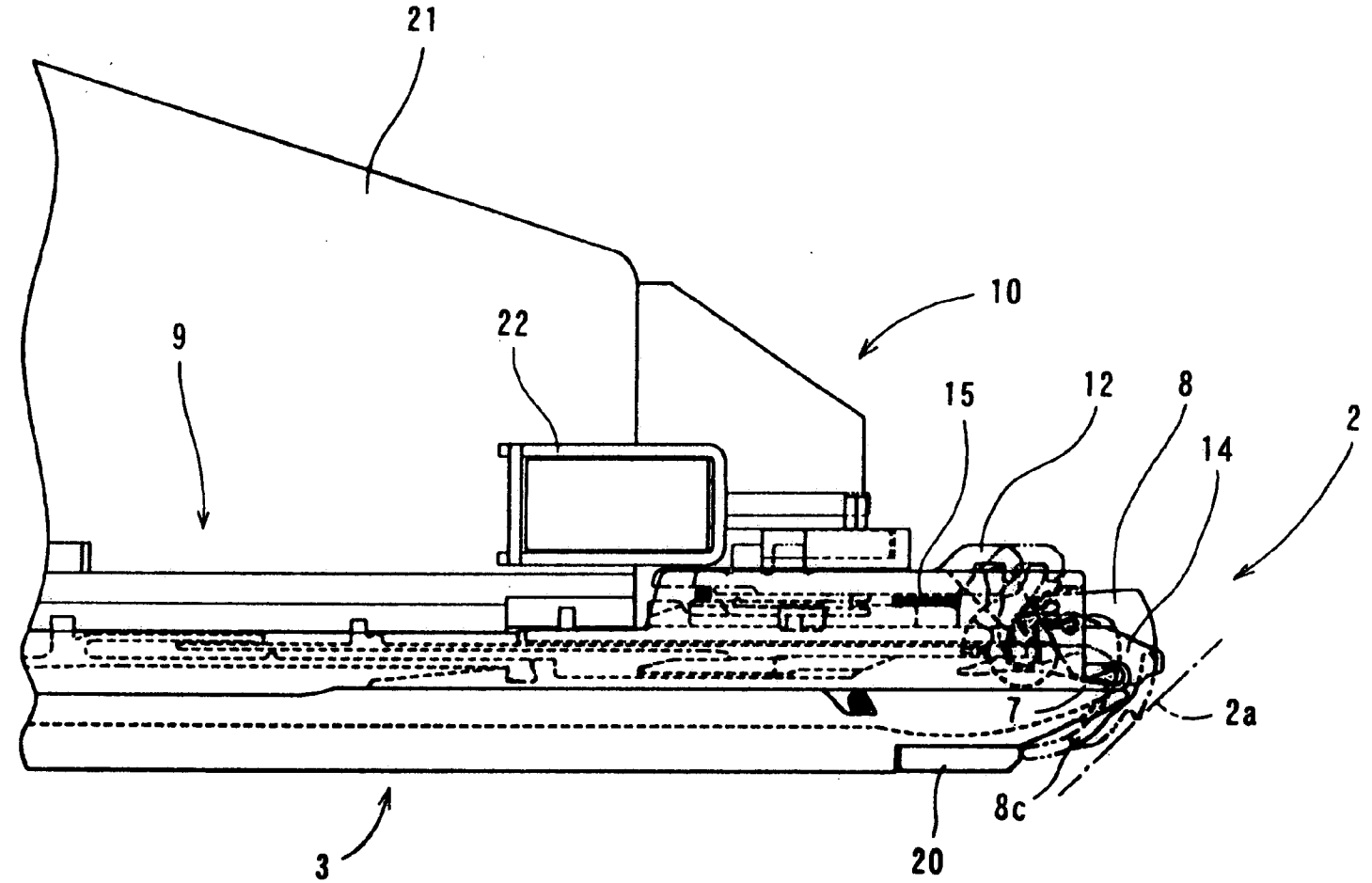
FIG. 6 is a lateral view of the vicinity of the needle bed gap 2 including a carriage 21 in the weft knitting machine in FIG. 1.

FIG. 6 shows a partial configuration of a carriage 21 on which the knitting needle operation cam mechanism 9 and the sinker operation cam mechanism 10 described above are mounted. The carriage 21 is provided also with a solenoid 22 as a driving source for the drive mechanism described later. Since the iron band 15 regulates the sliding displacement not at the upper portion of the sinker jack 12 but at the middle portion, a spacing between the sinker operation cam mechanism 10 and the end portion 12*a* of the sinker jack 12 at the rest position is made narrow, so that the spreading is prevented, and thus the portion can be made smaller.

Figure 7:
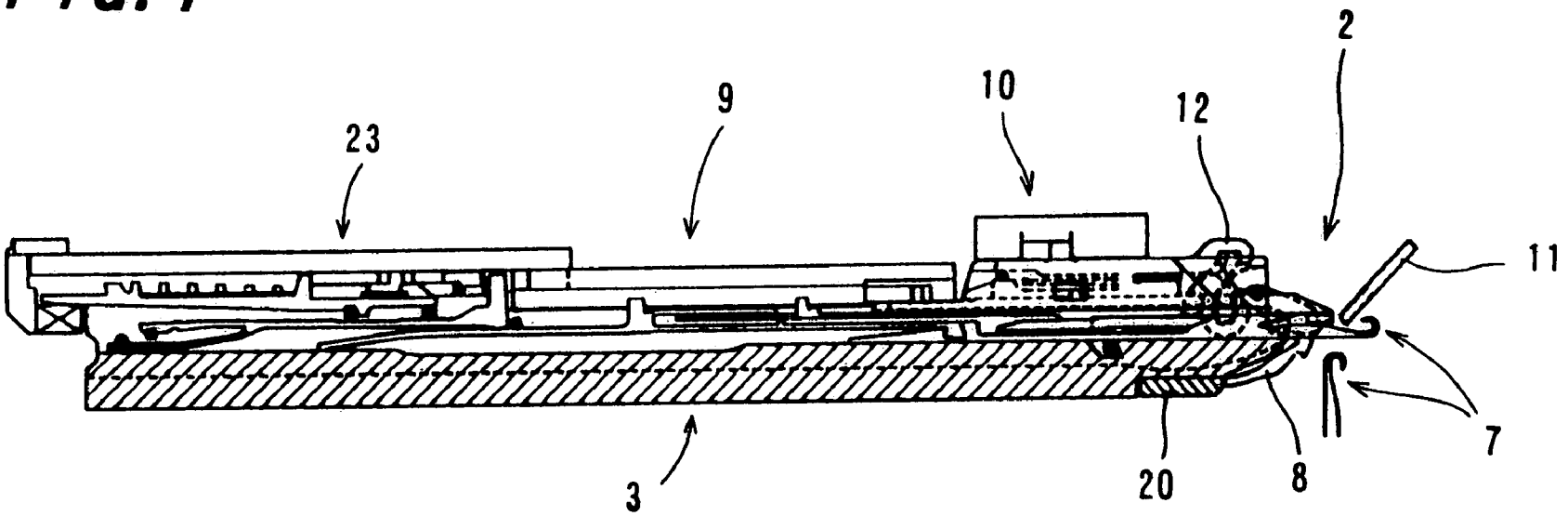
FIG. 7 is a lateral view showing an overall configuration with respect to a needle bed 3 in the weft knitting machine in FIG. 1.

FIG. 7 shows an overall configuration of mechanisms mounted on the carriage 21 in FIG. 6 and the needle bed 3. The carriage 21 in FIG. 6 is provided also with a needle selection mechanism 23 for selecting the knitting needles 7 used for knitting, in accordance with data for knitting a knitted fabric. The knitting needles 7 are selected by the needle selection mechanism 23 and a knitting operation with the knitting needles 7 is performed by the knitting needle operation cam mechanism 9 as in a known manner, and thus the description thereof has been omitted.

Figure 8:
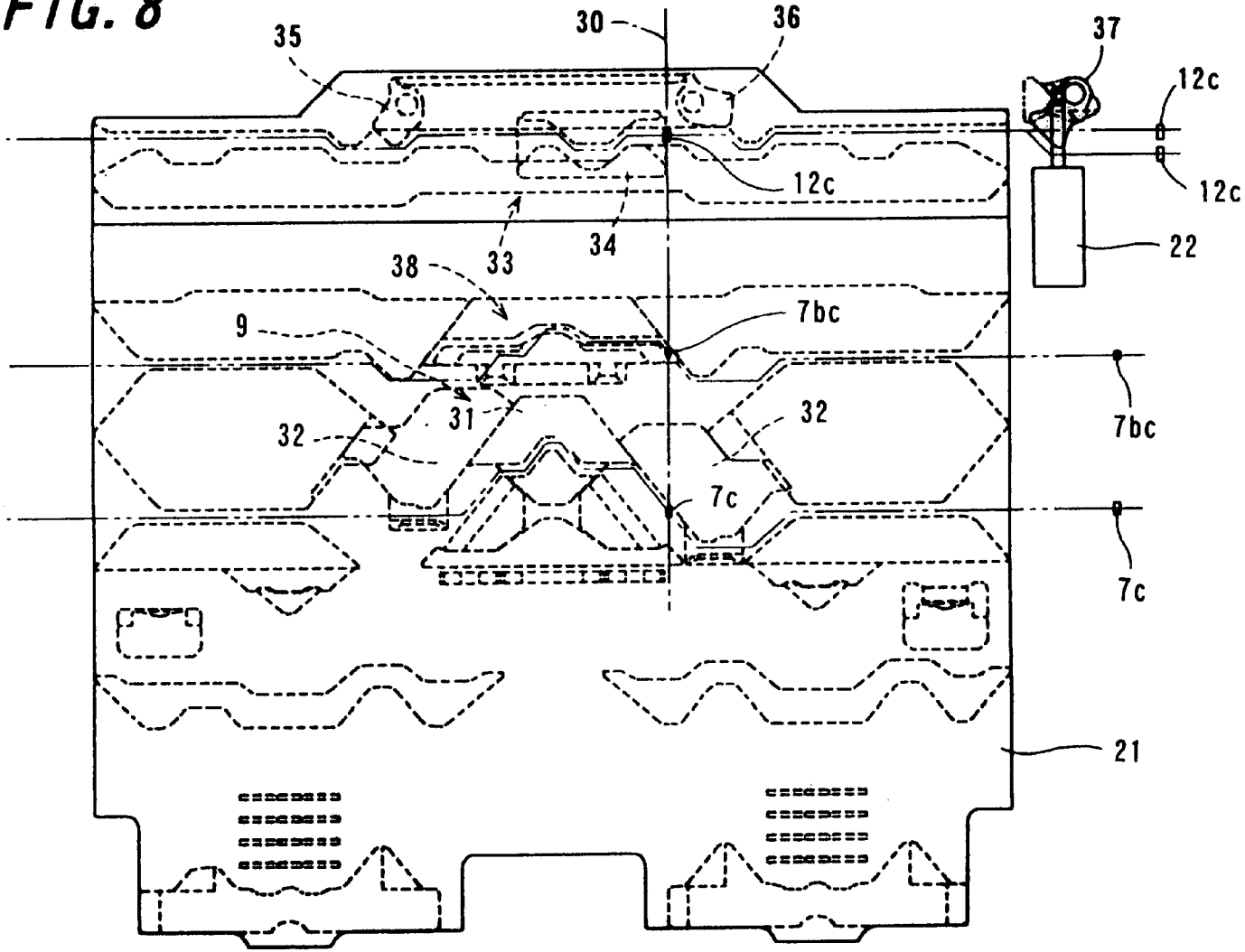
FIG. 8 is a plan view showing a schematic configuration of cam mechanisms mounted on the carriage 21 in the weft knitting machine in FIG. 1.

FIG. 8 shows a schematic configuration of the cam mechanisms mounted on the carriage 21. The knitting needle operation cam mechanism 9 acts on a butt 7*c* of the knitting needle 7. A case is assumed in which the carriage 21 moves from the right to the left direction in FIG. 8. A yarn feeding position 30 is the position at which the butt 7*c* has passed an upper cam 31 and reaches a stitch cam 32 in the knitting needle operation cam mechanism 9. A sinker cam 33 of the sinker operation cam mechanism 10 acts on the butt 12*c* of the sinker jack 12. The sinker cam 33 includes a movement cam 34 and a pair of swing cams 35 and 36. The movement cam 34 is pressed by the butt 12*c* and is shifted to the side of the yarn feeding position 30. The swing cams 35 and 36 move in conjunction with each other such that the front side in the travel direction of the carriage 21 operates and the rear side does not operate. A rest cam 37 is driven by the solenoid 22, and can move the butt 12*c* of the sinker jack 12 backward to the rest position in a state indicated by the solid line. When the rest cam 37 is in a state indicated by the dashed double dotted line, the rest cam 37 does not act on the butt 12*c*, and the butt 12*c* is set at the forward position by the fixing portion of the sinker cam 33.

The rest cam 37 is provided only on one side of the carriage 21, but it is also possible to provide the rest cam 37 on both sides. It is natural that even when provided only on one side, it is sufficient to set a dummy course if necessary such that the rest cam 37 operates without fail before a racking operation. The carriage 21 is provided also with a slider cam 38 that acts on a butt 7*bc* of the slider 7*b*. A cam that acts on a butt 14*c* for the yarn guide 14 is also disposed, but is not shown in the drawing.

As described above, the rest cam 37 uses the solenoid 22 shown in FIG. 6 as a driving source, and functions as a drive mechanism that can switch between operation/non-operation in accordance with presence/absence of excitation of the solenoid 22. When the rest cam 37 is operated by electrically exciting the solenoid 22 mounted on the carriage 21, the butt 12*c* of the sinker jack 12 is driven such that the sinker jack 12 is moved backward to the position at which the sinker jack 12 is interlocked in the interlock mechanism 16, and thus a rest state can be kept even after the carriage 21 has passed.

Figure 9:
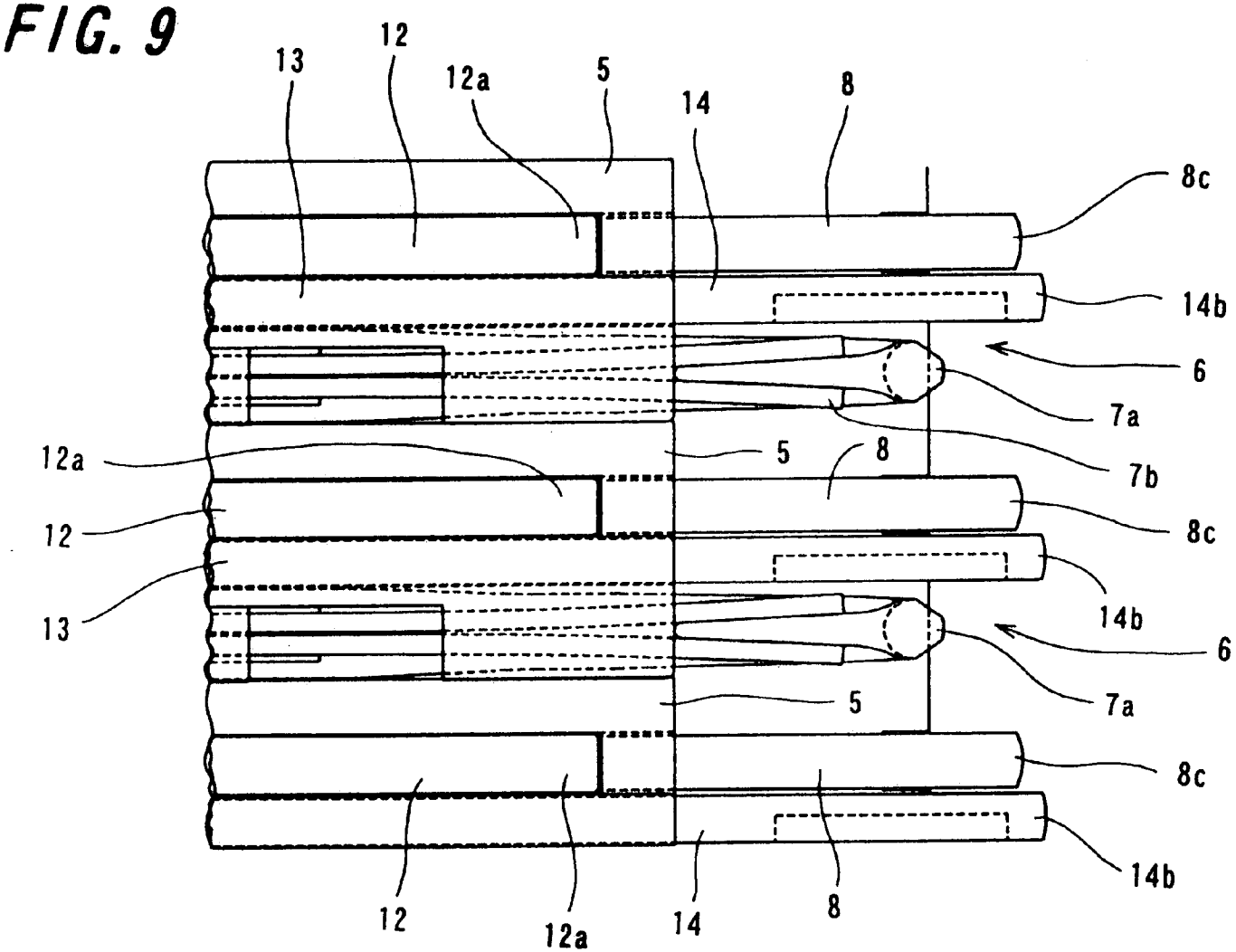
FIG. 9 is a plan view showing an enlarged vicinity of the needle bed gap 2 in FIG. 1.

FIG. 9 shows an enlarged vicinity of the needle bed gap 2. The needle grooves 6 are formed between the needle plates 5. The bottom portions of the spacers 13 regulate the needle main portions 7*a* and the sliders 7*b* of the knitting needles 7 so as not to move upward away from the base stage 4. The movable sinkers 8 and the sinker jacks 12, for example, are accommodated between the side portions of the spacers 13 and the needle plates 5.

Figure 10:
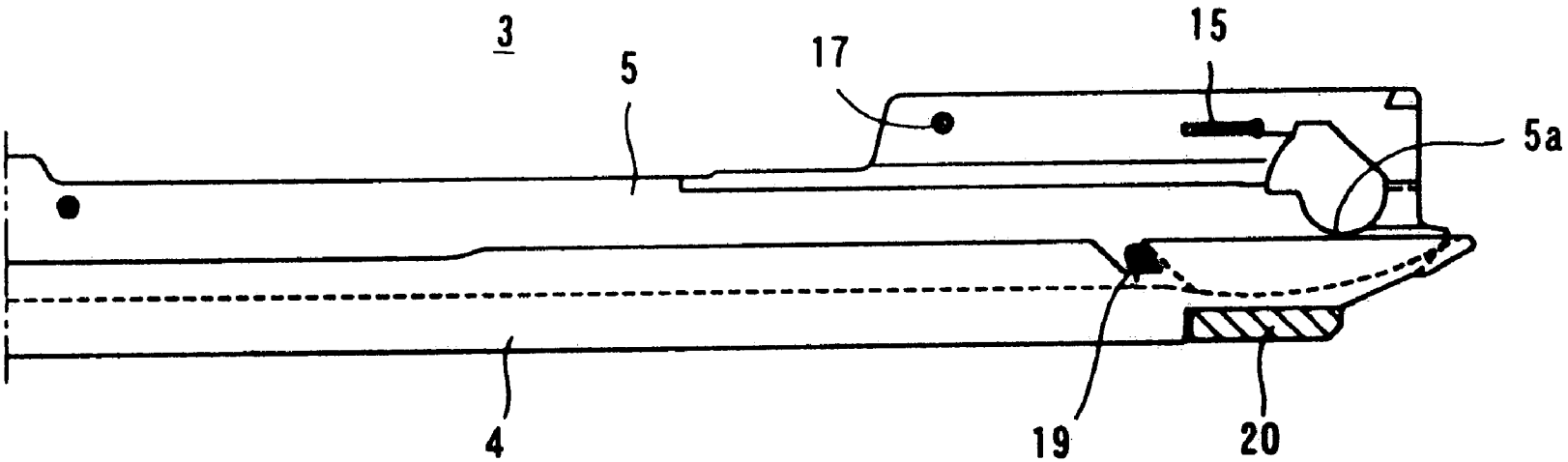
FIG. 10 is a lateral view showing the configuration of the needle bed 3 in FIG. 1.
Figure 11:
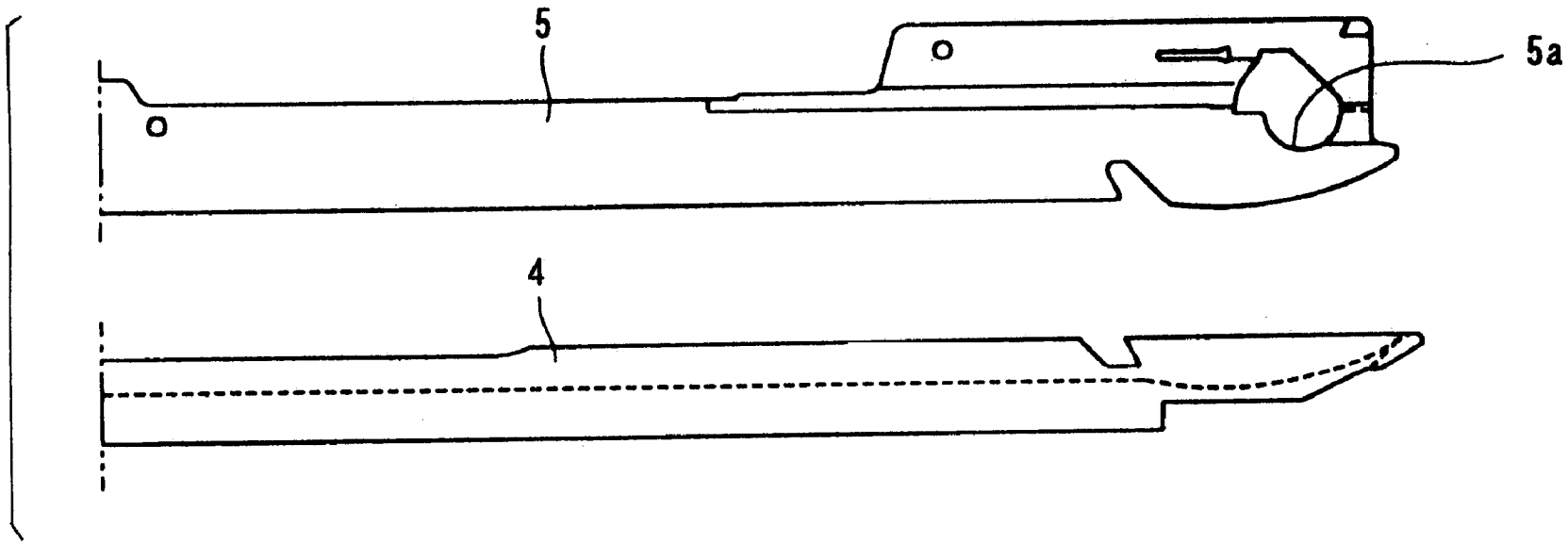
FIG. 11 is a lateral view of a base stage 4 and a needle plate 5, which constitute the needle bed 3 in FIG. 1.
Figure 12:
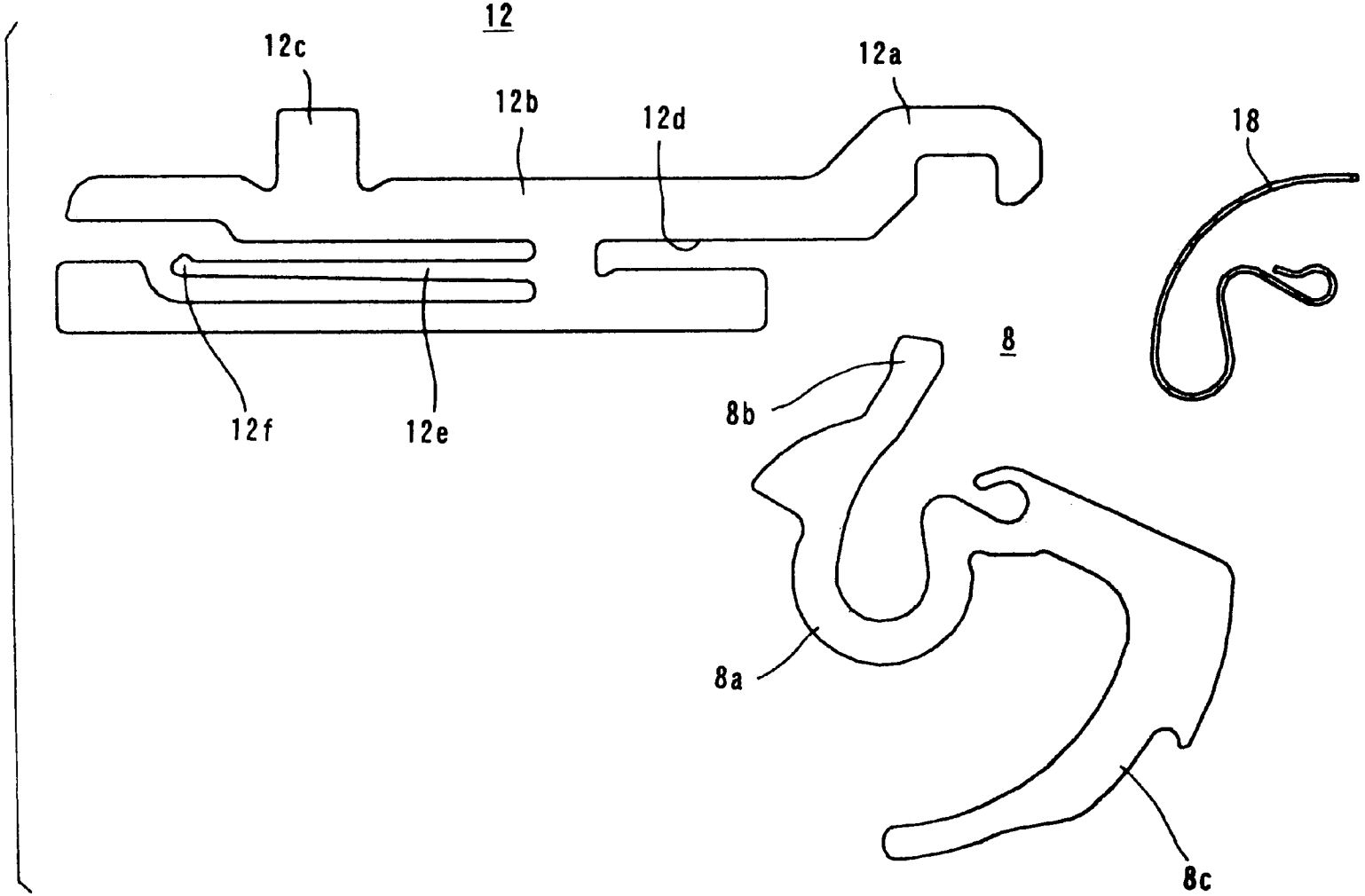
FIG. 12 is a lateral view showing the shape of a movable sinker 8, a sinker jack 9, and a wire spring 18 in FIG. 1.

FIG. 10 shows the configuration of the needle bed 3. FIG. 11 shows the shape of the base stage 4 and the needle plate 5, which constitute the needle bed 3. FIG. 12 shows the shape of the movable sinker 8, the sinker jack 9, and the wire spring 18.

Figure 13:
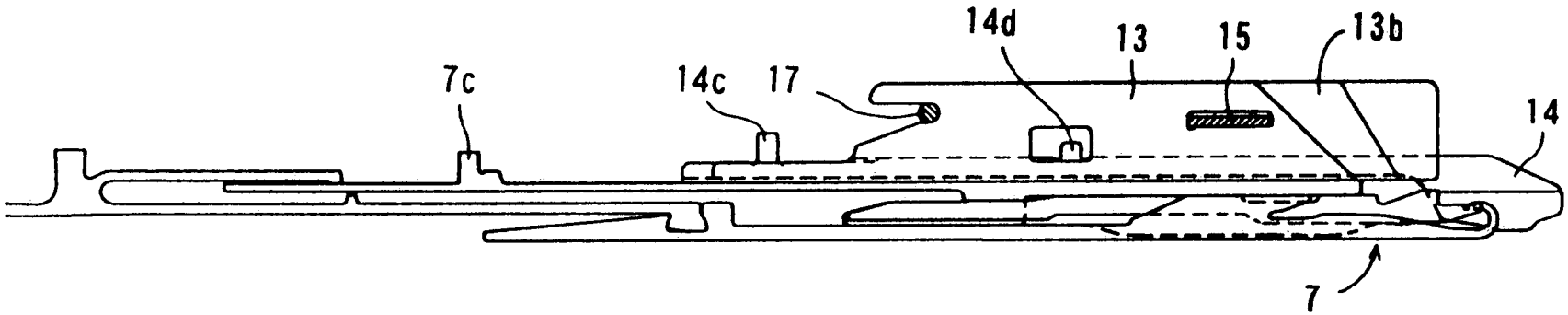
FIG. 13 is a lateral view showing a state in which a knitting needle 7, a spacer 13, and a yarn guide 14 in FIG. 1 are combined.
Figure 14:
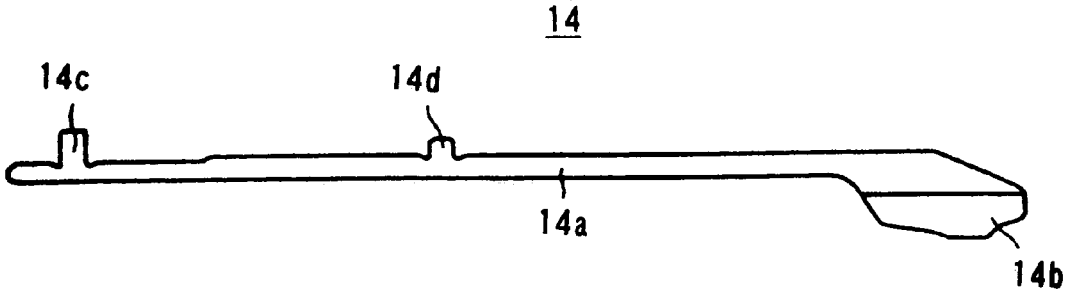
FIG. 14 is a lateral view showing the shape of the yarn guide 14 in FIG. 15.
Figure 15:
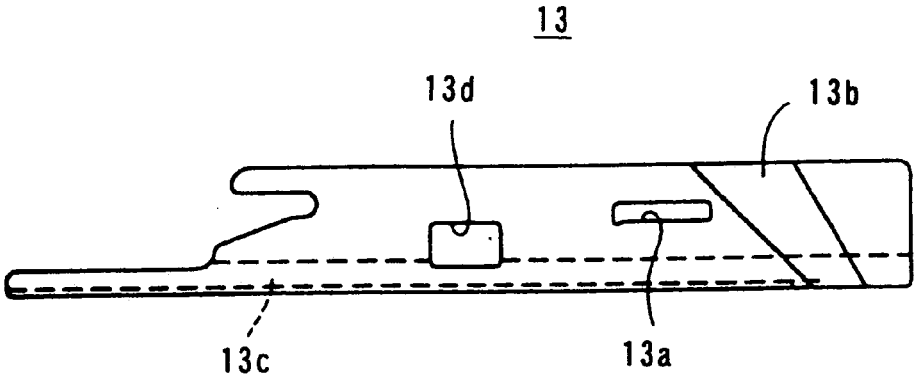
FIG. 15 is a lateral view showing the shape of the spacer 13 in FIG. 15.
Figure 16:
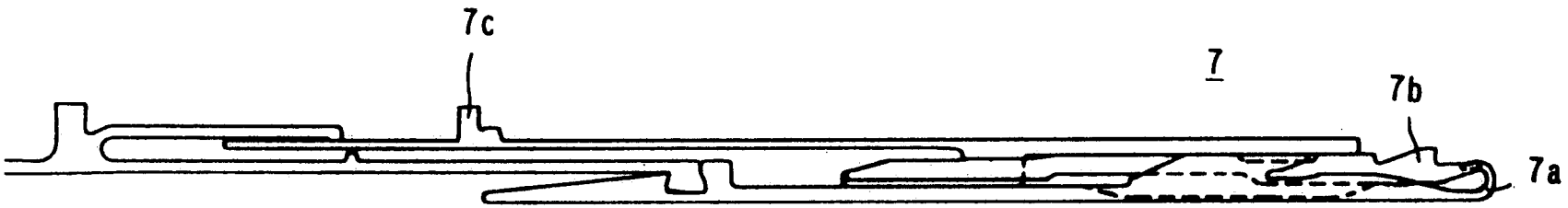
FIG. 16 is a lateral view showing the shape of the knitting needle 7 in FIG. 15.

FIG. 13 shows a state in which the knitting needle 7, the spacer 13, and the yarn guide 14 are combined. FIG. 14 shows the shape of the yarn guide 14. FIG. 15 shows the shape of the spacer 13. FIG. 16 shows the shape of the knitting needle 7. The spacer 13 is fixed on the needle plate 5 with the iron band 15 and the wire 17. The spacer 13 is provided with an elongated hole 13*a* through which the iron band 15 passes. Furthermore, the spacer 13 is provided also with an inclined groove 13*b* as an air path that is open on the side of the surface of the needle bed 3 and that is in communication with the front end of the knitting needle 7. When the inclined groove 13*b* is used as an air path and air is led to flow from the side of the surface of the needle bed 3, it is possible to clean up the needle bed gap 2 by blowing away yarn waste and the like in the vicinity of the front end of the knitting needle 7.

On the face of the spacer 13 that is opposed to the face provided with the inclined groove 13*b*, also is provided a groove 13*c* that extends in the direction of the back and forth movement. The groove 13*c* has the shape that fits the base portion 14*a* of the yarn guide 14. In a state fitted into the groove 13*c* of the spacer 13, the base portion 14*a* of the yarn guide 14 is disposed in the direction away from the base stage of the needle bed with respect to the knitting needle 7, and on the bottom portion, the knitting needle 7 is slidingly displaced in the direction of the back and forth movement, and thus the yarn guide 14 can be compactly accommodated in each of the needle grooves 6.

Furthermore, the base portion 14*a* of the yarn guide 14, which is fitted into the groove 13*c* of the spacer 13 and is slidingly displaced, is provided with a protrusion 14*d*. The groove 13*c* of the spacer 13 is provided with a window 13*d* serving as a recess for regulating the range in which the protrusion 14*d* of the yarn guide 14 is displaced. With the window 13*d* provided at the groove 13*c* of the spacer 13, into which the base portion 14*a* of the yarn guide 14 is fitted and is slidingly displaced, the range in which the protrusion 14*d* provided on the base portion 14*a* of the yarn guide 14 is disposed is limited, so that the range in which the yarn guide 14 operates can be regulated.

Figure 17:
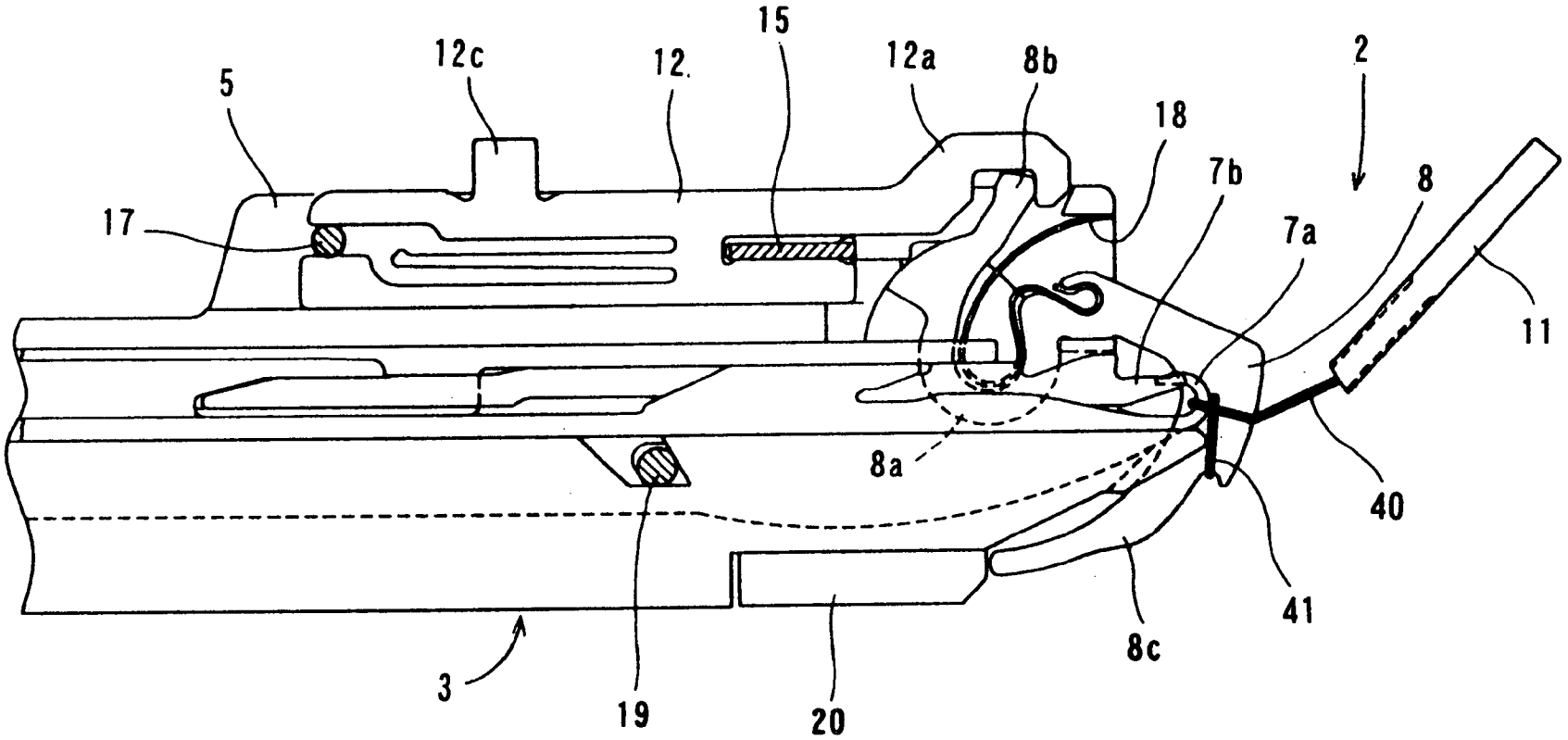
FIG. 17 is a lateral view showing a state in which a knitted fabric 41 is knitted by feeding a knitting yarn 40 from a yarn feeder 11 at the needle bed gap 2 in FIG. 1.
Figure 18:
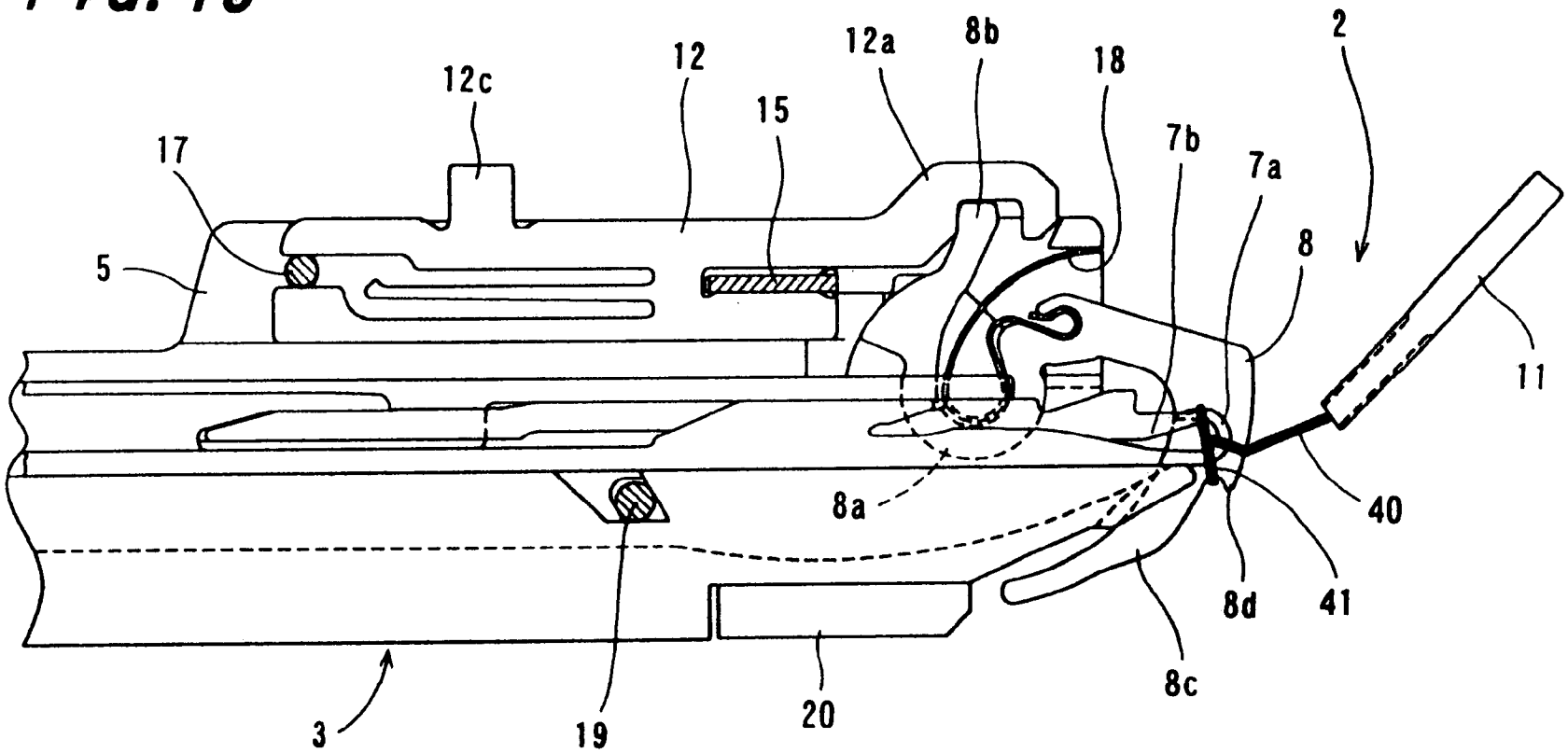
FIG. 18 is a lateral view showing a state in which the knitted fabric 41 is knitted by feeding the knitting yarn 40 from the yarn feeder 11 at the needle bed gap 2 in FIG. 1.

FIGS. 17 and 18 show a state in which a knitted fabric 41 is knitted by feeding a knitting yarn 40 from the yarn feeder 11 at the needle bed gap 2. FIG. 17 shows a state in which a force of the wire spring 18 is greater than a resisting force of the knitting yarn 40, and the operation portion 8*c* of the movable sinker 8 presses a knitting loop 41. FIG. 18 shows a state in which the needle main portion 7*a* and the slider 7*b* move forward to the side of the needle bed gap 2, a tensile force of the knitting yarn 40 becomes stronger, and the operation portion 8*c* of the movable sinker 8 has moved backward. The passive portion 8*b* of the movable sinker 8 has a protrusion that projects toward the side of the end portion 12*a* of the sinker jack 12. The end portion 12*a* of the sinker jack 12 has a recess that is wider than the width of the protrusion. The passive portion 8*b* of the movable sinker 8 and the end portion 12*a* of the sinker jack 12 are engaged with each other with the recess and the protrusion. The protrusion, which is on the passive portion 8*b* of the movable sinker 8 and which projects toward the side of the end portion 12*a* of the sinker jack 12, is engaged with the recess, which is on the side of the end portion 12*a* of the sinker jack 12 and which is wider than the width of the protrusion. When a force of the wire spring 18 is applied, the protrusion and one side of the recess abut against each other, so that the knitted fabric can be pressed. When a resisting force from the knitted fabric becomes greater than a force applied by the wire spring 18, the movable sinker 8 can be swingingly displaced such that the protrusion abuts against the other side of the recess, and thus a tensile force generated in the knitting yarn 40 can be relaxed, so that too strong a tensile force is not applied.

A state as shown in FIG. 18 is achieved during a so-called stitch determination. In a state of stitch determination, when knock-over is performed in which the knitting loop 41 surmounts a hook of the needle main portion 7*a* that is closed by the slider 7*b* of the knitting needle 7, the operation portion 8*c* of the movable sinker 8 is moved backward by a resisting force from the previous loop. Also in this case, the rearmost position of the movable sinker 8 can be regulated with the gap at the end portion 12*a* of the sinker jack 12 and the abutting against the passive portion 8*b* of the movable sinker 8, and thus it is possible to regulate a portion of a catch 8*d* of the operation portion 8*c* of the movable sinker 8 so as not to move upward beyond the bottom of the needle. Accordingly, the knitting yarn that is fed from the yarn feeder 11 to the hook of the yarn main portion 7*a* can be led to abut against a location above the catch 8*d* on the movable sinker 8. The size of a knitting loop that is formed at this time is determined based on the amount in which the knitting needle 7 is pulled down, using the location abutting against the movable sinker 8 as a reference.

Figure 19:
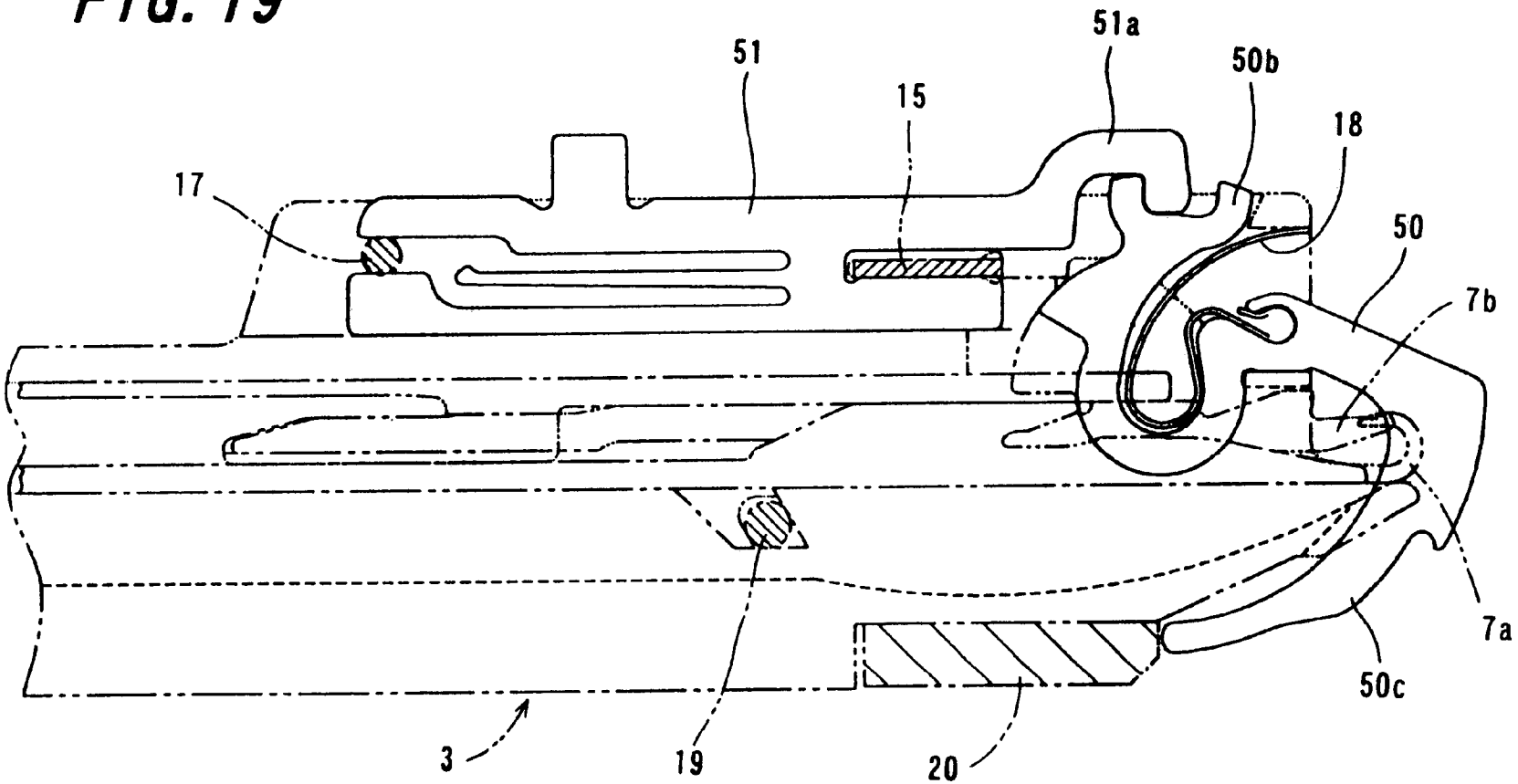
FIG. 19 is a lateral view showing a partial configuration of another embodiment of the invention.

FIG. 19 shows the configuration of an engaged portion between a movable sinker 50 and a sinker jack 51, which is another embodiment of the invention. Other components are similar to those in the embodiment described based on FIGS. 1 to 18, and thus the description thereof has been omitted. In this embodiment, an end portion 51*a* of the sinker jack 51 has a protrusion that projects toward the side of a passive portion 50*b* of the movable sinker 50. The passive portion 50*b* of the movable sinker 50 has a recess that is wider than the width of the protrusion. The passive portion 50*b* of the movable sinker 50 and the end portion 51*a* of the sinker jack 51 are engaged with each other with the recess and the protrusion. The protrusion, which is on the end portion 51*a* of the sinker jack 51 and which projects toward the side of the passive portion 50*b* of the movable sinker 50, is engaged with the recess, which is provided on the side of the passive portion 50*b* of the movable sinker 50 and which is wider than the width of the protrusion. With this gap, when a force of the wire spring 18 is applied, the protrusion and one side of the recess abut against each other, so that the knitted fabric can be pressed, as in the embodiment in FIGS. 1 to 20. When a resisting force from the knitted fabric becomes greater than a force applied by the wire spring 18, the movable sinker 50 can be swingingly displaced such that the protrusion abuts against the other side of the recess, and thus a tensile force generated in the knitting yarn can be relaxed, so that too strong a tensile force is not applied.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

Furthermore, all variations and modifications falling within the range of equivalency of the appended claims are intended to be embraced in the scope of the invention.

INDUSTRIAL APPLICABILITY

According to at least one embodiment of the invention, when a butt of a sinker jack is driven with a cam mechanism of a carriage in the direction of the back and forth displacement, it is possible to swingingly displace a movable sinker, and thus an operation portion of the movable sinker can be moved forward into and backward from an area for knitting a knitted fabric. Even when a passive portion of the movable sinker is brought close to a support portion in the vicinity of the area for knitting a knitted fabric, it is not necessary that a mechanism for directly pressing the passive portion is provided on the side of the carriage. Accordingly, the carriage can be made smaller by letting the carriage not cover the vicinity of the area for knitting a knitted fabric on the needle bed, and thus a wide space can be secured at the needle bed close to the area for knitting a knitted fabric.

An interlock mechanism lets the sinker jack driven by a drive mechanism so as to move backward be interlocked at the backward position. Thus, even after the carriage has passed, it is possible to keep a state in which the sinker jack is held at the backward position and thus the operation portion of the movable sinker has moved backward from the area for knitting a knitted fabric. When a needle bed gap in which the front and rear needle beds are opposed to each other is used as the area for knitting a knitted fabric, it is possible to eliminate a possibility of damaging by scratching a knitted fabric, by letting the operation portion of the movable sinker be withdrawn from the needle bed gap when various types of knitted fabrics are knitted in a racking operation.

Furthermore, according to at least one embodiment of the invention, a member passing through the needle plate is used in order to interlock the sinker jack, and thus it is possible to make the interlock mechanism compact.

Furthermore, according to at least one embodiment of the invention, when a cam is operated by electrically exciting a solenoid mounted on the carriage, the butt of the sinker jack is driven such that the sinker jack is moved backward to the position at which the sinker jack is interlocked in the interlock mechanism, and thus a rest state can be kept even after the carriage has passed.

According to at least one embodiment of the invention, a compound needle is used as the knitting needle. Thus, a knitting cam provided on the carriage can be made smaller, and it is possible to reliably knit a knitted fabric with the compound needle when using the movable sinker and a yarn guide. The needle groove is provided with a spacer whose bottom portion regulates the knitting needle so as not to move away from the base stage, whose side portion regulates the sinker jack so as not to be shifted in the width direction of the needle groove, and whose side portion has a groove that extends in the direction of the back and forth movement. A base portion of the yarn guide is fitted into the groove of the spacer and is slidingly displaced. Thus, the yarn guide can be compactly accommodated in each needle groove.

Furthermore, according to at least one embodiment of the invention, with a recess provided at the groove of the spacer, into which the base portion of the yarn guide is fitted and is slidingly displaced, the range in which a protrusion provided on the base portion of the yarn guide is displaced is limited, so that the range in which the yarn guide operates can be regulated.

Furthermore, according to at least one embodiment of the invention, when air is led to flow from the side of the surface of the needle bed, via an air path provided in the spacer, it is possible to clean up the vicinity of the front end of the knitting needle.

According to at least one embodiment of the invention, the passive portion of the movable sinker and the end portion of the sinker jack are engaged with each other by a force applied by a spring such that the passive portion and the end portion abut against each other on one side and a gap is provided for clearance on the other side. Thus, when a resisting force from a knitting yarn, which is received by the operation portion of the movable sinker, becomes greater than a force applied by the spring, there is room in which the movable sinker is swingingly displaced such that the operation portion moves backward from the area for knitting a knitted fabric, and thus a tensile force generated in the knitting yarn can be relaxed so as not to be too strong.

Furthermore, according to at least one embodiment of the invention, the gap at a portion in which the passive portion of the movable sinker and the end portion of the sinker jack are engaged with each other is formed such that the position of a catch for pressing a knitting loop that has been knitted, on the operation portion of the movable sinker, is regulated to be on the side that is different from the position of a yarn feeding port for feeding a knitting yarn to a hook, with respect to the position through which the hook of the knitting needle passes when the knitting needle is displaced forward into and backward from the area for knitting a knitted fabric. For example, when a knitting yarn is fed from the upper side of the needle bed gap with respect to the knitting needle, the catch of the movable sinker is regulated so as to be below the bottom of the needle. Thus, even at the rearmost position of the movable sinker, it is possible to form a normal knitting loop by pressing a knitted fabric with the catch of the operation portion of the movable sinker.

Furthermore, according to at least one embodiment of the invention, a protrusion, which is on the passive portion of the movable sinker and which projects toward the side of the end portion of the movable sinker, is engaged with a recess, which is on the side of the end portion of the sinker jack and which is wider than the width of the protrusion. When a force of the spring is applied, the protrusion and one side of the recess abut against each other, so that the knitted fabric can be pressed. When a resisting force from the knitted fabric becomes greater than a force applied by the spring, the movable sinker can be swingingly displaced such that the protrusion abuts against the other side of the recess, and thus a tensile force generated in the knitting yarn can be relaxed, so that too strong a tensile force is not applied.

Furthermore, according to at least one embodiment of the invention, a protrusion, which is on the end portion of the sinker jack and which projects toward the side of the passive portion of the movable sinker, is engaged with a recess, which is provided on the side of the passive portion of the movable sinker and which is wider than the width of the protrusion. When a force of the spring is applied, the protrusion and one side of the recess abut against each other, so that the knitted fabric can be pressed. When a resisting force from the knitted fabric becomes greater than a force applied by the spring, the movable sinker can be swingingly displaced such that the protrusion abuts against the other side of the recess, and thus a tensile force generated in the knitting yarn can be relaxed, so that too strong a tensile force is not applied.

The invention claimed is:

1. A weft knitting machine having moveable sinkers, in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are selectively moved forward into and backward from the area for knitting a knitted fabric, so that a knitted fabric is knitted by an interaction with the movable sinkers, wherein the end portions, on a side of the area for knitting a knitted fabric, of the needle plates have recess portions for supporting the movable sinkers such that the movable sinkers can be swingingly displaced, and wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, the weft knitting machine, comprising:

a sinker jack that is accommodated in each of the needle grooves, can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof;

a passing-through member that passes through each of the needle plates in a direction along the area for knitting a knitted fabric, and is inserted into the cutout portion of the sinker jack and thus regulates the sinker jack so as to be slidingly displaced without moving away from the needle groove;

a drive mechanism that is provided on the carriage, and is capable of selectively driving the sinker jack, by acting on the butt of the sinker jack, to move backward from the area for knitting a knitted fabric such that the operation portion of the movable sinker is withdrawn from the area for knitting a knitted fabric; and an interlock mechanism that is provided in a position away from the area for knitting a knitted fabric, within a range in which the sinker jack is displaced back and forth, in each of the needle grooves, and that interlocks, at a backward position so as to restrain the back and forth displacement in the needle grooves, the sinker jack driven by the drive mechanism so as to move backward.

2. The weft knitting machine of claim 1, wherein the interlock mechanism interlocks a protrusion provided on a side of the base portion of the sinker jack with a member passing through the needle plate in a direction along the area for knitting a knitted fabric.

3. The weft knitting machine of claim 1, wherein the drive mechanism uses a solenoid as a driving source, includes a cam that can switch between operation/non-operation in accordance with presence/absence of excitation of the solenoid, and moves, by operation of the cam, the butt backward to a position for interlocking with the interlock mechanism.

4. A weft knitting machine having movable sinkers, in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are selectively moved forward into and backward from the area for knitting a knitted fabric, so that a knitted fabric is knitted by an interaction with the movable sinkers, wherein the end portions, on a side of the area for knitting a knitted fabric, of the needle plates have recess portions for supporting the moveable sinkers such that the movable sinkers can be swingingly displaced, wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, wherein the knitting, needle is disposed with the movable sinker side by side in a width direction in each of the needle grooves, and is a compound needle in which a needle main portion and a slider can be independently displaced forward into and backward from the area for knitting a knitted fabric, and wherein each of the needle grooves includes:

a sinker jack that can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof, a spacer that is disposed in a direction away from the base stage of the needle bed with respect to the knitting needle, whose bottom portion regulates the knitting needle so as not to move away from the base stage, whose side portion regulates the sinker jack so as not to be shifted in a width direction of the needle groove, and whose side portion has a groove that extends in a direction of the back and forth movement, and a yarn guide that has a base portion that is fitted into the groove of the spacer such that the base portion can slide in the direction of the back and forth movement, and a yarn pressing portion that is formed on a side of the area for knitting a knitted fabric with respect to the base portion and that can press a knitting yarn by moving forward into the area for knitting a knitted fabric, the weft knitting machine, further comprising:

a passing-through member that passes through the spacer and the needle plate in each of the needle grooves in a direction along the area for knitting a knitted fabric and thus fixes the spacer and the needle plate on each other, and that is inserted into the cutout portion of the sinker jack and thus regulates the sinker jack so as to be slidingly displaced without moving away from the needle groove.

5. The weft knitting machine of claim 4, wherein:

the base portion of the yarn guide that is fitted into the groove of the spacer and is slidingly displaced is provided with a protrusion, and the groove of the spacer is provided with a recess for regulating a range in which the protrusion of the yarn guide is displaced.

6. The weft knitting machine of claim 4, wherein the spacer is provided with an air path that is open on a side of a surface of the needle bed and that is in communication with a side of the area for knitting a knitted fabric of the knitting needle.

7. A weft knitting machine having movable sinkers, in which in which a needle bed is formed such that a large number of needle plates are arranged in a direction toward an area for knitting a knitted fabric, on a base stage that is disposed facing the area for knitting a knitted fabric, the needle plates are formed so as to have a small plate thickness at end portions on a side of the area for knitting a knitted fabric, needle grooves whose width becomes large on a side of the area for knitting a knitted fabric are formed between the needle plates, and a knitting needle is accommodated in each of the needle grooves, and a movable sinker is accommodated at each of end portions of the needle grooves in which the width becomes large, and in which while letting a carriage travel back and forth on the needle bed along the area for knitting a knitted fabric, the knitting needles are selectively moved forward into and backward from the area for knitting a knitted fabric, so that a knitted fabric is knitted by an interaction with the movable sinkers, wherein the end portions, on a side of the area for knitting a knitted fabric, of the needles plates have recess portions for supporting the movable sinkers such that the movable sinkers can be swingingly displaced, and wherein the movable sinkers have support portions that are supported by the recess portions, passive portions that are driven following a back and forth displacement with respect to the area for knitting a knitted fabric, and operation portions that operate as sinkers with respect to the area for knitting a knitted fabric when a back and forth displacement with respect to the passive portions is converted into a swinging displacement with the support portions serving as supporting points, the passive portions being biased by spring force so that the operation portions move forward into the area for knitting a knitted fabric, the weft knitting machine, comprising:

a sinker jack that is accommodated in each of the needle grooves, can be displaced forward into and backward from the area for knitting a knitted fabric, is engaged with the passive portion of the movable sinker at an end portion, has a butt projecting in a direction away from the base stage of the needle bed on a side of a base portion extending in a direction away from the area for knitting a knitted fabric with respect to the end portion, and has a groove that extends in a direction of the back and forth displacement in a middle between the end portion and the base portion and in a middle of the needle groove in a depth direction thereof, a passing-through member that passes through each of the needle plates in a direction along the area for knitting a knitted fabric, and is inserted into the cutout portion of the sinker jack and thus regulates the sinker jack so as to be slidingly displaced without moving away from the needle groove, and a spring for applying a force to the moveable sinker such that the operation portion moves forward into the area for knitting a knitted fabric, wherein the passive portion of the movable sinker and the end portion of the sinker jack are engaged with each other by a force applied by the spring such that the passive portion and the end portion abut against each other on one side and a gap is provided for clearance on the other side.

8. The weft knitting machine of claim 7, wherein:

the operation portion of the movable sinker is provided with a catch for pressing a knitting loop that has been knitted, and the gap at a portion in which the passive portion of the movable sinker and the end portion of the sinker jack are engaged with each other is formed, within a range from a state in which the passive portion and the end portion abut against each other on one side of the gap to state in which the passive portion and the end portion abut against each other on the other side of the gap, such that a position of the catch of the movable sinker is regulated to be on a side that is different from a position of a yarn feeding port for feeding a knitting yarn to a hook, with respect to a position through which the hook of the knitting needle passes when the knitting needle is displaced forward into and backward from the area for knitting a knitted fabric.

9. The weft knitting machine of claim 7, wherein:

the passive portion of the movable sinker has a protrusion that projects toward a side of the end portion of the sinker jack, the end portion of the sinker jack has a recess that is wider than a width of the protrusion, and the engagement is made with the recess and the protrusion.

10. The weft knitting machine of claim 7, wherein:

the end portion of the sinker jack has a protrusion that projects toward a side of the passive portion of the movable sinker, the passive portion of the movable sinker has a recess that is wider than a width of the protrusion, and the engagement is made with the recess and the protrusion.

11. The weft knitting machine of claim 2, wherein the drive mechanism uses a solenoid as a driving source, includes a cam that can switch between operation/non-operation in accordance with presence/absence of excitation of the solenoid, and moves, by operation of the cam, the butt backward to a position for interlocking with the interlock mechanism.

12. The weft knitting machine of claim 5, wherein the spacer is provided with an air path that is open on a side of a surface of the needle bed and that is in communication with a side of the area for knitting a knitted fabric of the knitting needle.

13. The weft knitting machine of claim 8, wherein:

the passive portion of the movable sinker has a protrusion that projects toward a side of the end portion of the sinker jack, the end portion of the sinker jack has a recess that is wider than a width of the protrusion, and the engagement is made with the recess and the protrusion.

14. The weft knitting machine of claim 8, wherein:

the end portion of the sinker jack has a protrusion that projects toward a side of the passive portion of the movable sinker, the passive portion of the movable sinker has a recess that is wider than a width of the protrusion, and the engagement is made with the recess and the protrusion.

* * * * *